US010534296B2

(12) United States Patent
Iwasaki et al.

(10) Patent No.: US 10,534,296 B2
(45) Date of Patent: Jan. 14, 2020

(54) IMAGE HEATING APPARATUS THAT CONTROLS TIMING OF SWITCHING A THYRISTOR ON AND OFF BASED ON WHETHER A RECORDING MATERIAL IS IN A NIP

(71) Applicant: CANON KABUSHIKI KAISHA, Tokyo (JP)

(72) Inventors: Atsushi Iwasaki, Susono (JP); Masato Sako, Mishima (JP); Shotaro Yoshimura, Mishima (JP); Ryota Ogura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/207,790

(22) Filed: Dec. 3, 2018

(65) Prior Publication Data

US 2019/0171136 A1 Jun. 6, 2019

(30) Foreign Application Priority Data

Dec. 4, 2017 (JP) ..... 2017-232484

(51) Int. Cl.
*G03G 15/20* (2006.01)

(52) U.S. Cl.
CPC ..... *G03G 15/205* (2013.01)

(58) Field of Classification Search
CPC ..... G03G 15/205; G03G 15/2039; G03G 15/2042
See application file for complete search history.

(56) References Cited

U.S. PATENT DOCUMENTS

| | | | | |
|---|---|---|---|---|
| 6,336,009 | B1 | 1/2002 | Suzumi et al. | |
| 9,291,960 | B2 | 3/2016 | Yoshimura | |
| 2001/0020610 | A1* | 9/2001 | Yoshimura | H05B 1/0241 219/216 |
| 2016/0085187 | A1* | 3/2016 | Takagi | G03G 15/2042 399/69 |
| 2018/0032009 | A1 | 2/2018 | Ogura | |
| 2018/0335737 | A1 | 11/2018 | Ogura et al. | |

FOREIGN PATENT DOCUMENTS

| | | | |
|---|---|---|---|
| JP | H06-194933 | A | 7/1994 |
| JP | H06-194993 | A | 7/1994 |
| JP | 2000-162909 | A | 6/2000 |
| JP | 2003-337484 | A | 11/2003 |
| JP | 2013-073206 | A | 4/2013 |

* cited by examiner

*Primary Examiner* — Thomas S Giampaolo, II
(74) *Attorney, Agent, or Firm* — Venable LLP

(57) ABSTRACT

An image heating apparatus includes a first and second heat generating elements, a thyristor that controls electrical power supplied to the heat generating elements, and a relay that switches a supply destination of the electrical power supply between the heat generating elements. A controller switches the thyristor from on to off, and then actuates the relay to switch the supply destination from the first heat generating element to the second heat generating element, and, thereafter switches the thyristor from off to on. The controller sets a timing of switching of the thyristor from on to off to be in a period in which an image on a current recording material is in a nip, and sets timing of switching of the thyristor from off to on to be in a period in which an image on a current recording material or a subsequent recording material is not in the nip.

8 Claims, 15 Drawing Sheets

IMAGE HEATING APPARATUS THAT CONTROLS TIMING OF SWITCHING A THYRISTOR ON AND OFF BASED ON WHETHER A RECORDING MATERIAL IS IN A NIP

This application claims the benefit of Japanese Patent Application No. 2017-232484 filed on Dec. 4, 2017, which is hereby incorporated by reference herein in its entirety.

FIELD OF THE INVENTION AND RELATED ART

The present invention relates to an image heating apparatus that is used by an image forming apparatus.

An image forming apparatus, such as an electrophotographic copying machine and a laser beam printer, is provided with an image heating apparatus (which hereafter may be referred to as fixing apparatus) that is for fixing unfixed toner image formed on a sheet of recording medium by the application of heat and pressure. As a heating method for a fixing apparatus, a method that heats a sheet of recording medium and an unfixed toner image thereon with the use of a heating film has been proposed as a heating method that can reduce a fixing apparatus in electrical power consumption, in addition to a heating method of the so-called heat roller type, which employs a fixation roller that contains a halogen heater, for example, in its hollow.

A fixing apparatus of the so-called film heating type has a cylindrical film, a heater that is in contact with the inward surface of the film, and a pressure roller that forms a fixation nip between itself and film, with the film being sandwiched between the pressure roller and the heater.

Further, there has also been known such a fixing apparatus of the film heating type that uses a heating method based on electromagnetic induction. In the case of this type of fixing apparatus, an eddy current is generated in the film itself, or an electrically conductive member positioned closed to the film, to generate heat (Joule's) in the film.

A fixing apparatus of this type is likely to suffer from a phenomenon in which, as a substantial number of sheets of recording paper are continuously conveyed through a fixation nip, the out-of-sheet-path portions of the fixation nip, which are not robbed of heat by the sheets of recording paper, gradually increase in temperature. This phenomenon is more apparent in the case of a fixing apparatus that is low in thermal capacity than a fixing apparatus that is high in thermal capacity. As the out-of-sheet-path portions of the fixation nip continue to increase in temperature, some members of the fixing apparatus exceed the limit of their heat resistance. Thus, image forming apparatuses equipped with this type of fixing apparatus are designed so that they can be reduced in throughput, that is, they can be increased in sheet interval, for example, to deal with this problem, that is, in order to prevent the aforementioned members of a fixing apparatus from exceeding the limit of their heat resistance.

In order to prevent the out-of-sheet-path portions of the fixing nip from excessively increasing in temperature, without reducing an image forming apparatus in throughput, various fixing apparatuses, such as the following ones, have been proposed.

There has been disclosed, in Japanese Laid-open Patent Application No. H06-194993, a fixing apparatus that has only one heating member that can be switched in the selection of heat generation range.

There has been disclosed, in Japanese Laid-open Patent Application No. 2000-162909, a fixing apparatus that uses such a heater that has a ceramic substrate, and two or more heat generating members formed on one of the primary surfaces of the substrate. In the case of this fixing apparatus, the heating members are different in heating range, making it possible to select a proper one according to the width of a sheet of recording paper.

There has been disclosed, in Japanese Laid-open Patent Application No. 2003-337484, a fixing apparatus that has a ceramic substrate, and two or more heat generating members that are different in heat generation range. In the case of this fixing apparatus, the heat generating members are formed on both surfaces of the substrate to reduce the fixing apparatus in size.

Further, there has also been proposed, in Japanese Laid-open Patent Application No. 2013-73206, a fixing apparatus structured so that it can be switched in the selection of heating member to be used for heat generation. In the case of this fixing apparatus, two or more heat generation lines can be driven (supplied with electrical power) by a common triac, and the fixing apparatus is switched in the selection of heat generation line by a switching means, such as a relay circuit.

A fixing apparatus, such as the one disclosed in Japanese Laid-open Patent Application No. 2013-73206, which drives two or more heating lines with the use of a common triac, and is switched in the selection of heat generation line with the use of a relay circuit, or the like, suffered, however, from the following problem in a case in which a printing job, in which images are thermally fixed to sheets of recording paper, one for one, while the sheets are continuously conveyed.

Referring to FIG. 14, which is related to a conventional fixing apparatus of the aforementioned type, the relationship between the timing with which the fixing apparatus is switched in the selection of heat generation line, and the heat transfers from a heating member to the toner on a sheet of recording paper, is described. FIG. 14 schematically shows the timing with which heat is generated and conducts in the fixation nip, when the fixing apparatus is switched in the selection of heat generation line from the first heat generation line to the second one during a continuous printing job that uses a substantial number of sheets of recording paper.

The operation for switching a fixing apparatus in the selection of heat generation line has to be carried out in such a sequence that consists of a step in which the common triac is turned off, a step in which heating means is switched by the switching relay, and a step in which the triac is turned on after it is ensured that the heating means was switched. The reason why this switching operation has be carried out is that if the relay is switched while the triac is on, it is possible that the points of contact of the relay will become welded to each other.

Therefore, there occurs a short period in which the fixing apparatus is not supplied with electrical power, and, therefore, the heater temporarily reduces in the amount of heat generation, while the heating member is switched in heat generation line. This temporary reduction in the amount by which the heat generation line generates heat reduces the amount by which heat is transmitted from the heating member to a sheet of paper. Therefore, the toner image on a sheet of recording paper is insufficiently heated, making it possible that the fixation failure will occur.

Thus, the object of the present invention is to provide an image heating apparatus that is capable of preventing the problem that the toner image on a sheet of recording medium is unsatisfactorily heated due to the temporary reduction in the amount of heat generation, which occurs as the heating member is switched in heat generation line.

SUMMARY OF THE INVENTION

According to one aspect, the present invention provides an image heating apparatus for heating an image formed on a recording material, the apparatus comprising a nip forming unit providing a nip configured to nip and feed the recording material, a first heat generating element configured to heat the nip, a second heat generating element configured to heat the nip, a thyristor configured to control electrical power supplied to the first heat generating element and the second heat generating element, a relay configured to switch a supply destination of the electrical power supply between the first heat generating element and the second heat generating element, and a controller, wherein, when the controller switches the supply destination from the first heat generating element to the second heat generating element during heating the images on continuously supplied recording materials, the controller switches the thyristor from on-state to off-state, and then actuates the relay to switch the supply destination from the first heat generating element to the second heat generating element, and thereafter, switches the thyristor from the off-state to the on-state, and wherein the controller sets timing of a period for switching the supply destination such that the image on the recording material is not influenced by a temperature drop in the period.

Further features of the present invention will become apparent from the following description of exemplary embodiments with reference to the attached drawings.

Figure 4:
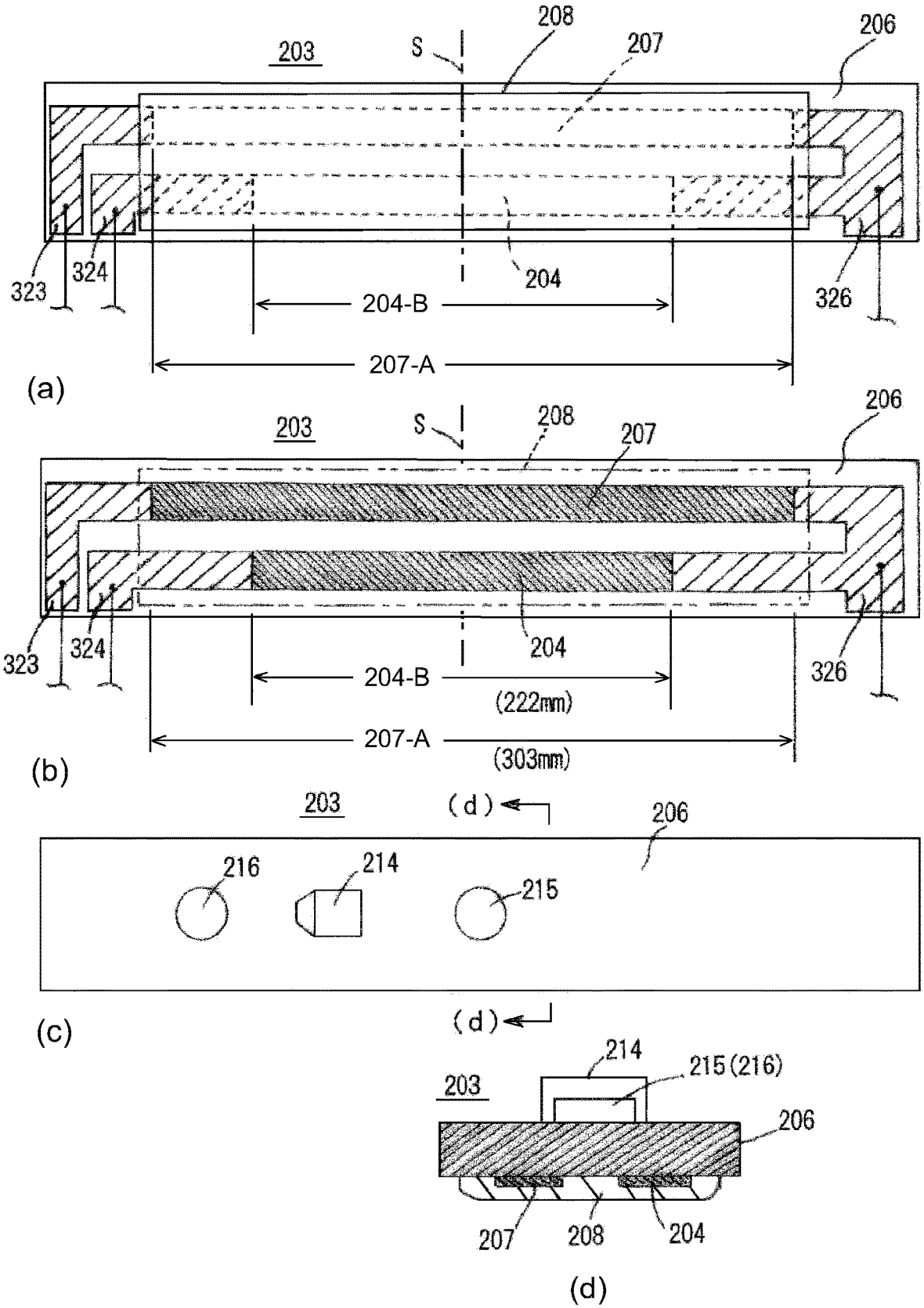

Parts (a), (b), (c), and (d) of FIG. 4 are schematic views of the heater of the fixing apparatus in the first embodiment, which is for explaining the structure of the heater.

Figure 5:
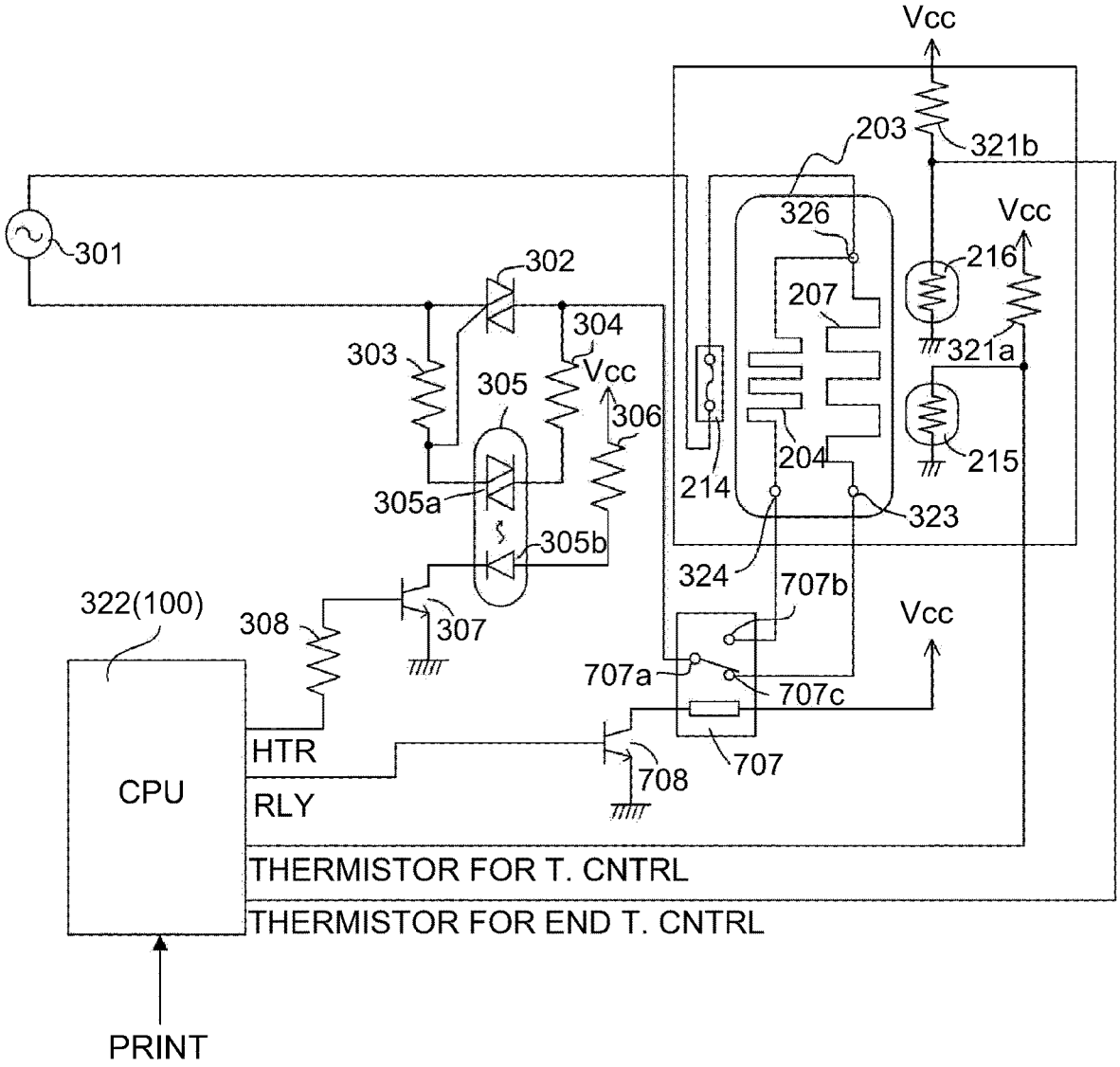

FIG. 5 is a schematic drawing of the electrical control circuit for driving the heater, and is for explaining the structure of the circuit.

Figure 6:
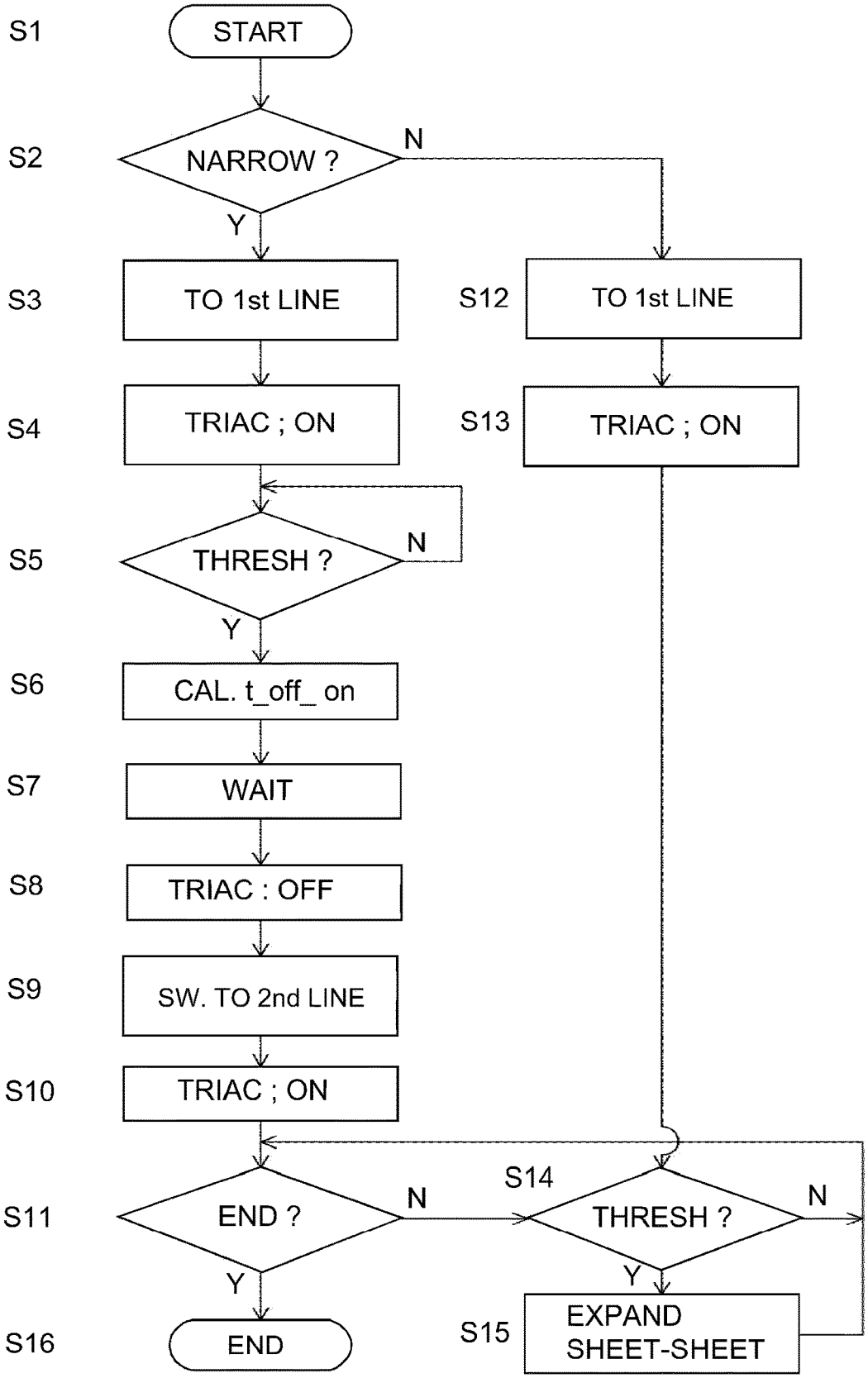

FIG. 6 is a flowchart of the heater control sequence in the first embodiment.

Figure 7:
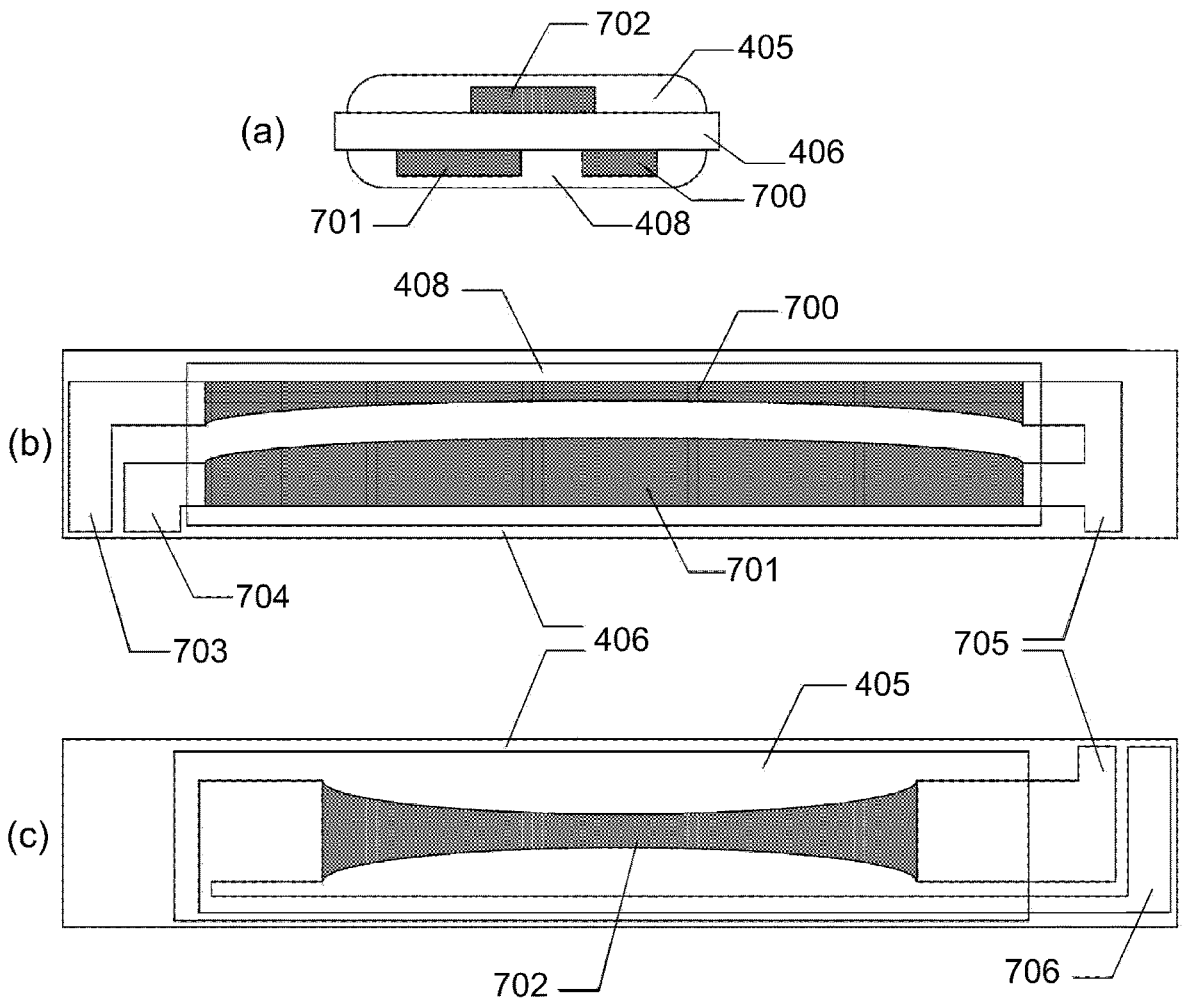

Parts (a), (b), and (c) of FIG. 7 are schematic views of the heater of the fixing apparatus in the second embodiment, and are for explaining the structure of the heater.

Figure 8:
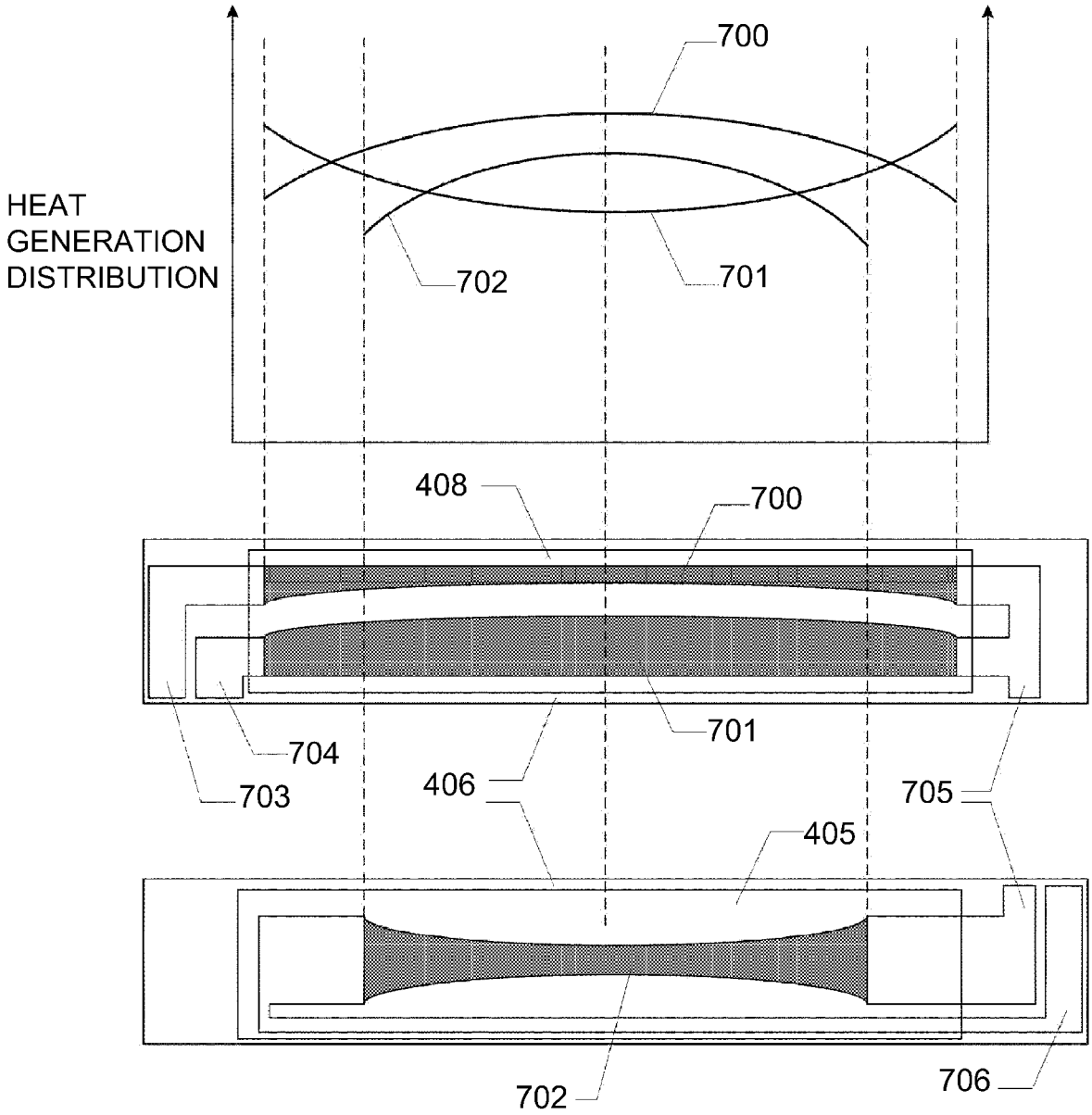

FIG. 8 is a drawing for explaining the pattern in which each heating member generates heat.

Figure 9:
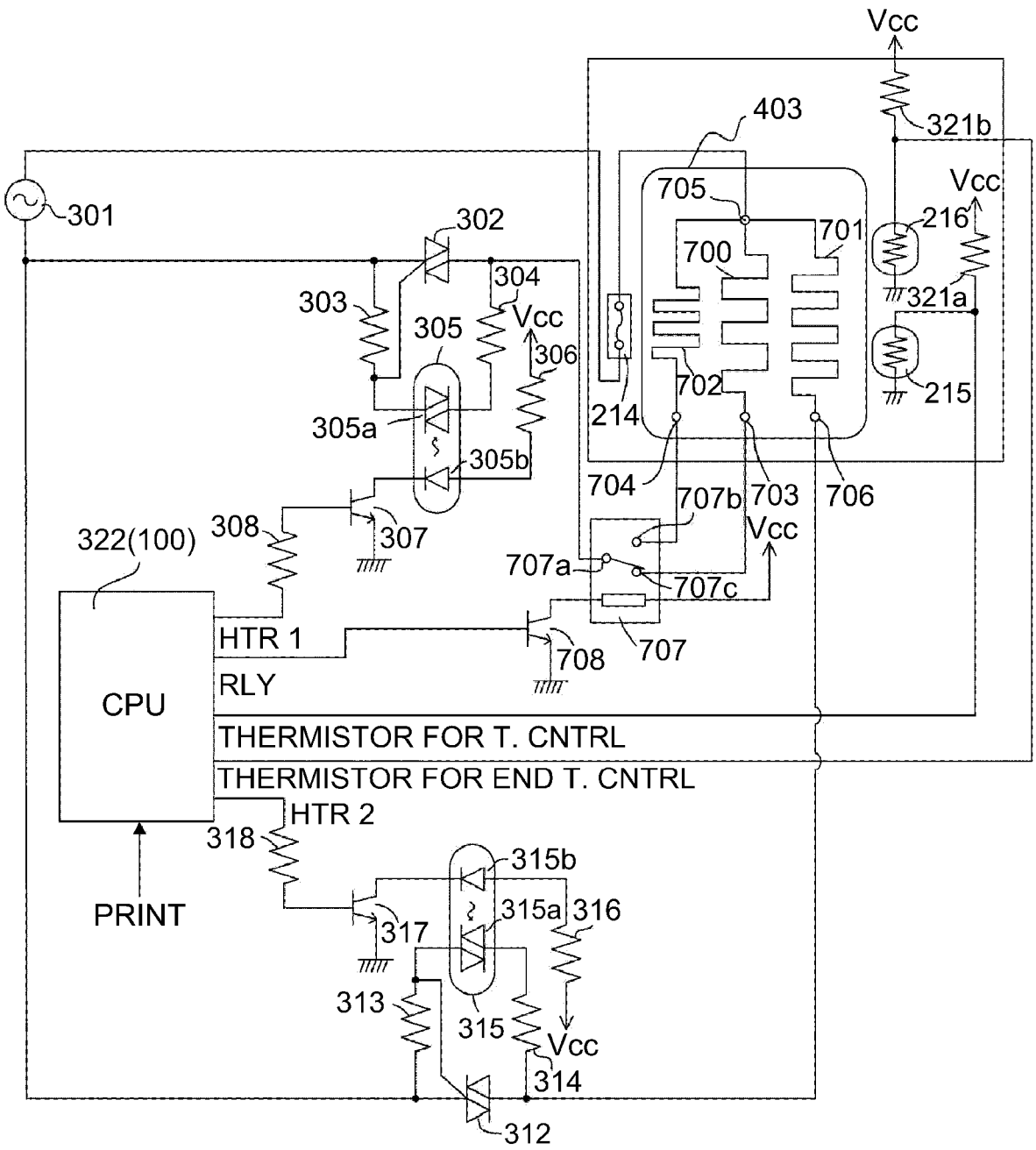

FIG. 9 is a schematic drawing of the electrical circuit for controlling the driving of the heater, and is for explaining the structure of the circuit.

Figure 10:
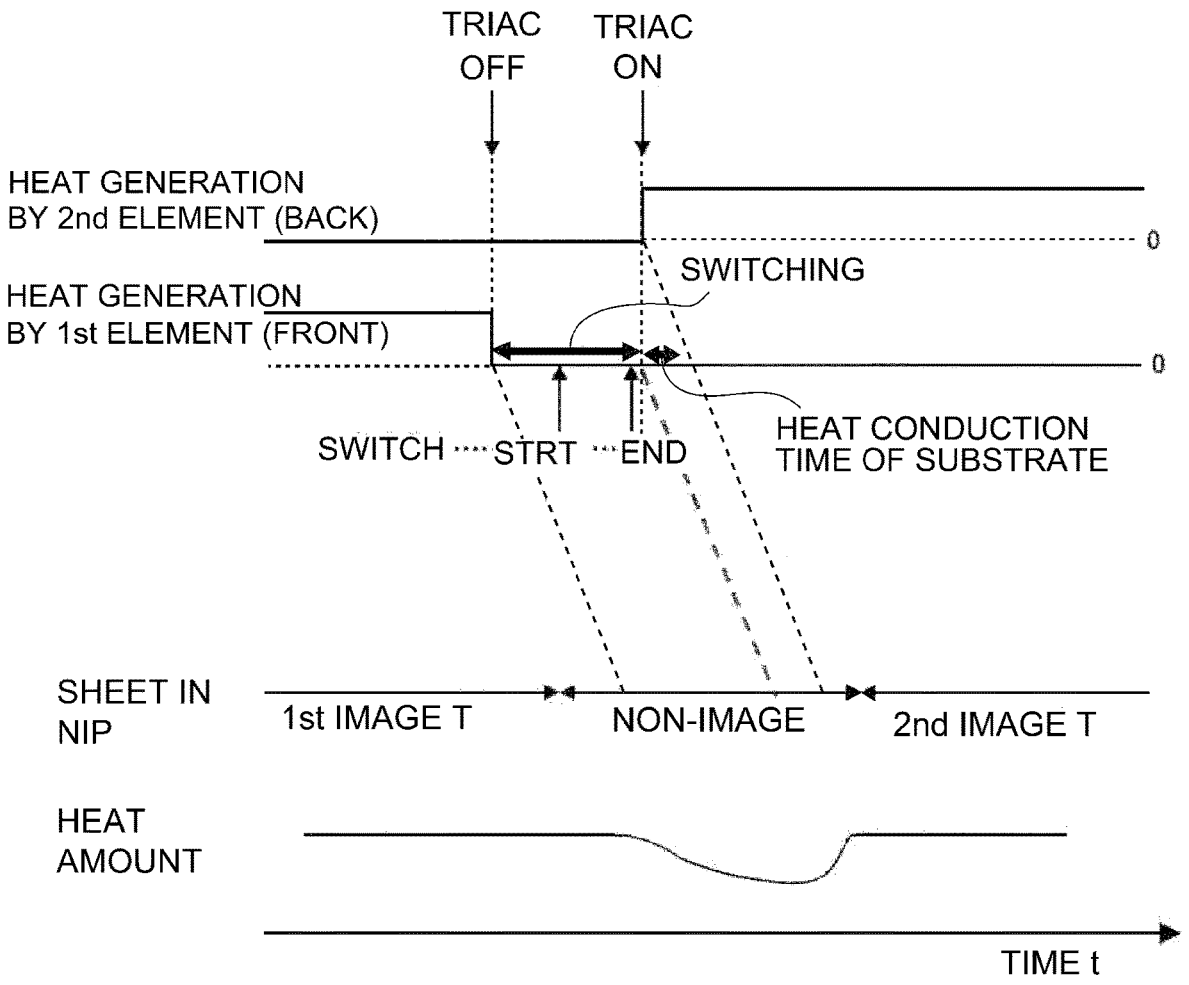

FIG. 10 is a schematic drawing for explaining the heat generation and heat conduction that occur in the fixing apparatus in the second embodiment of the present invention, when the apparatus is switched in heat generation line.

Figure 11:
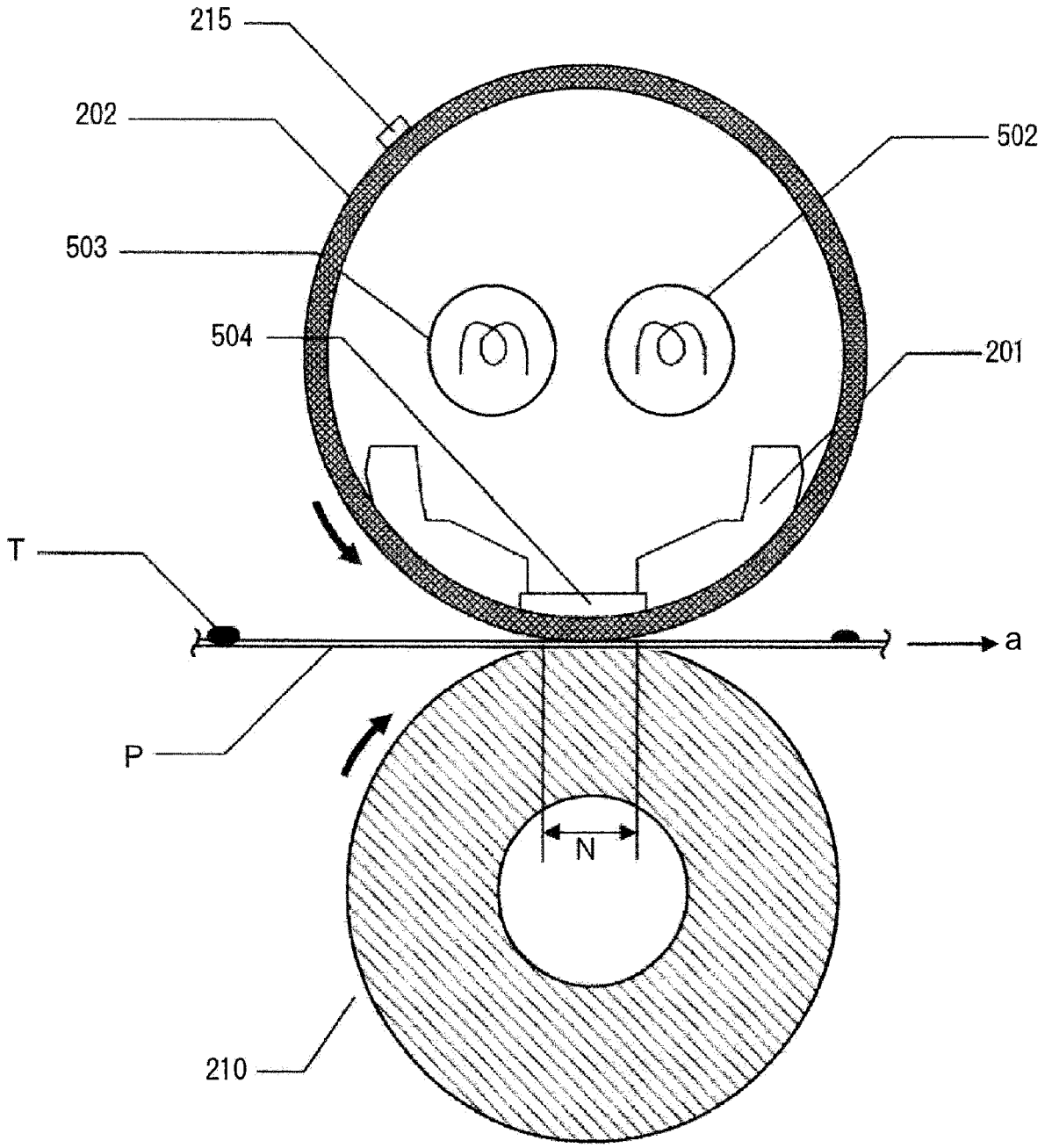

FIG. 11 is a schematic cross-sectional view of the essential portions of the fixing apparatus in the third embodiments of the present invention, which employs a heating belt and a radiant heating means.

Figure 12:
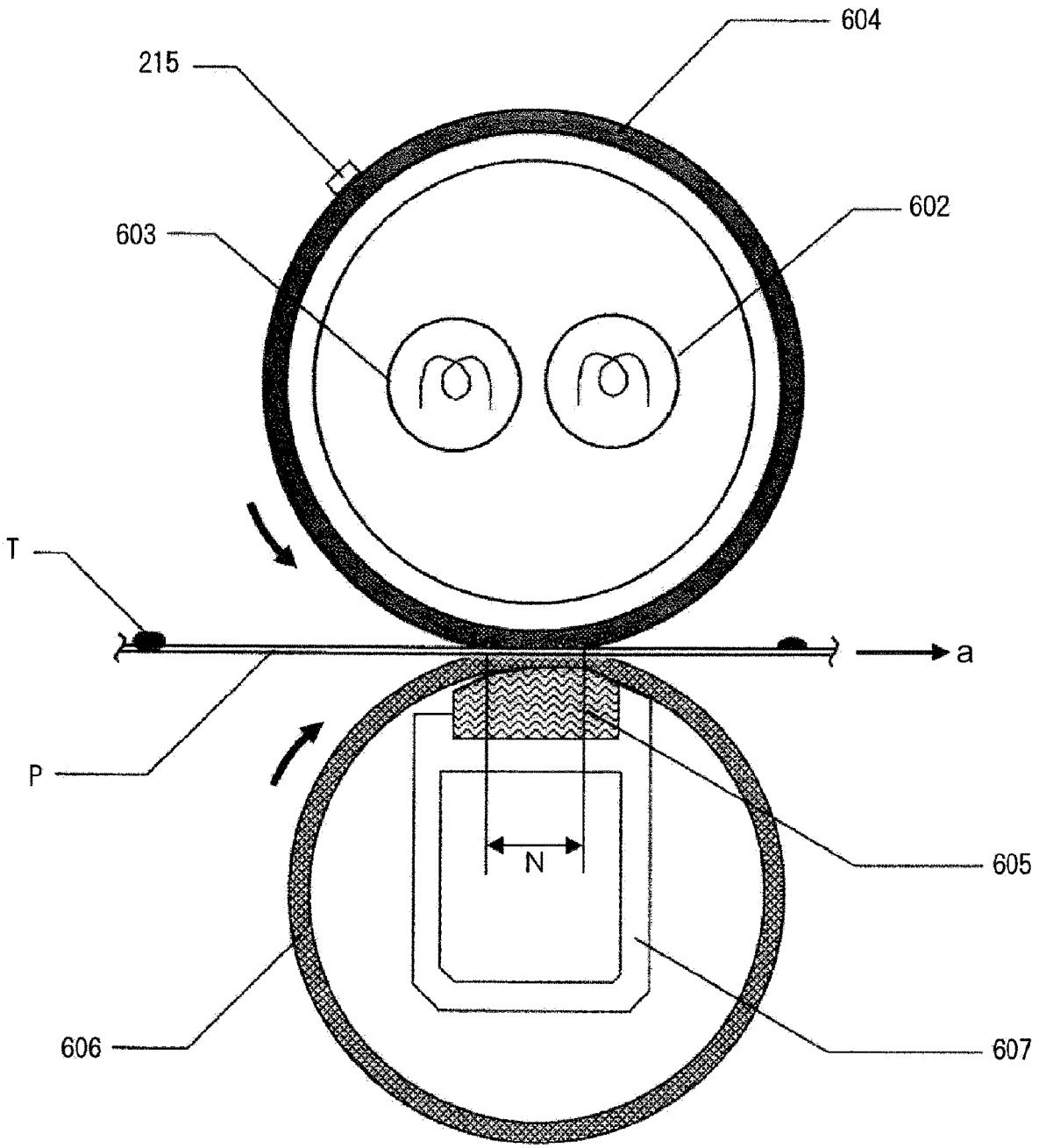

FIG. 12 is a schematic cross-sectional view of the essential portion of the fixing apparatus in the third embodiment, which employs a thin wall heat roller, a radiant heating means, a pressure belt, a pressure application pad, etc.

Figure 13:
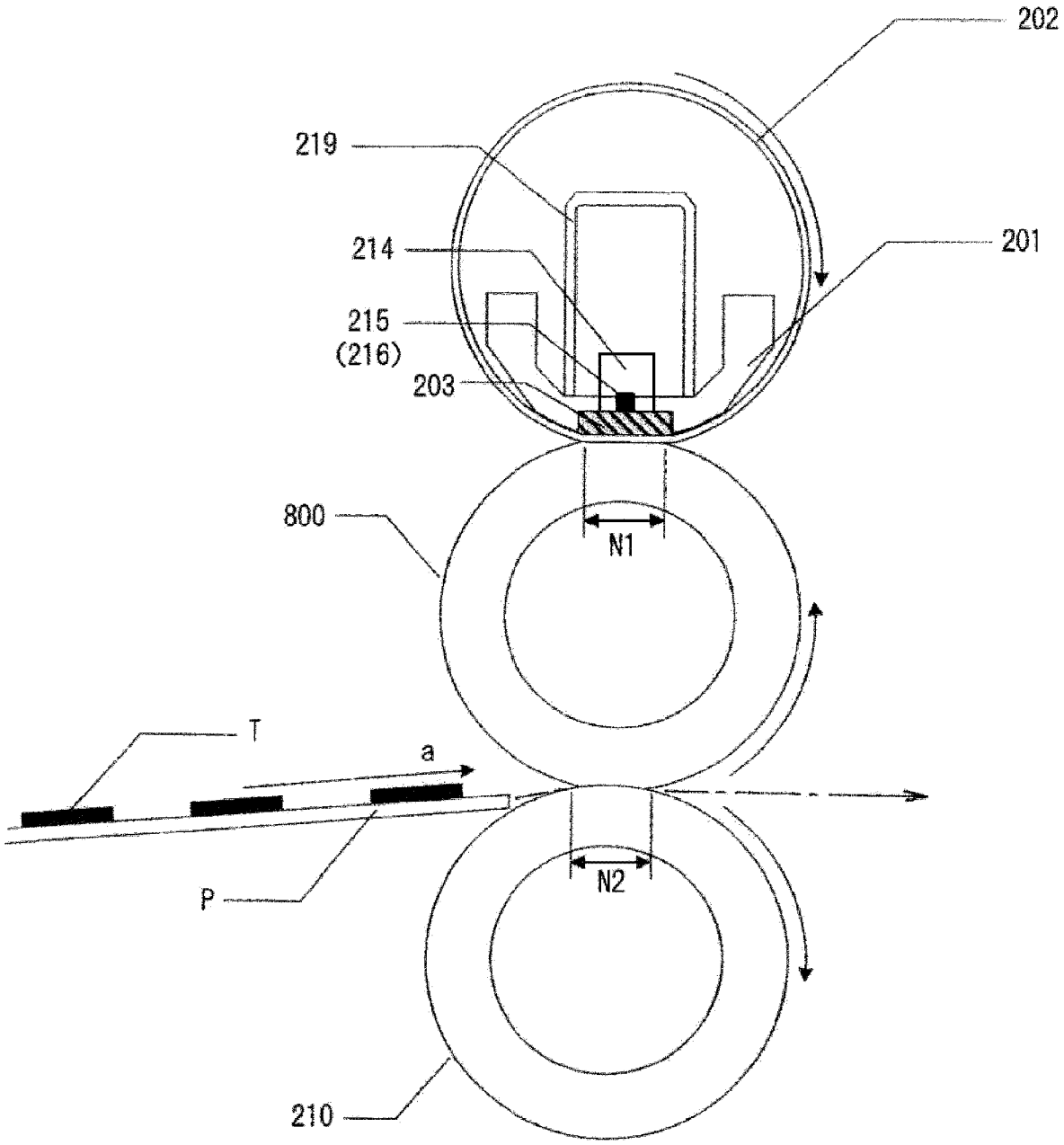

FIG. 13 is a schematic cross-sectional view of the essential portions of the fixing apparatus in the third embodiment, which employs a pressure roller, a fixation roller, and an external heating means for heating the peripheral surface of the fixation roller.

Figure 14:
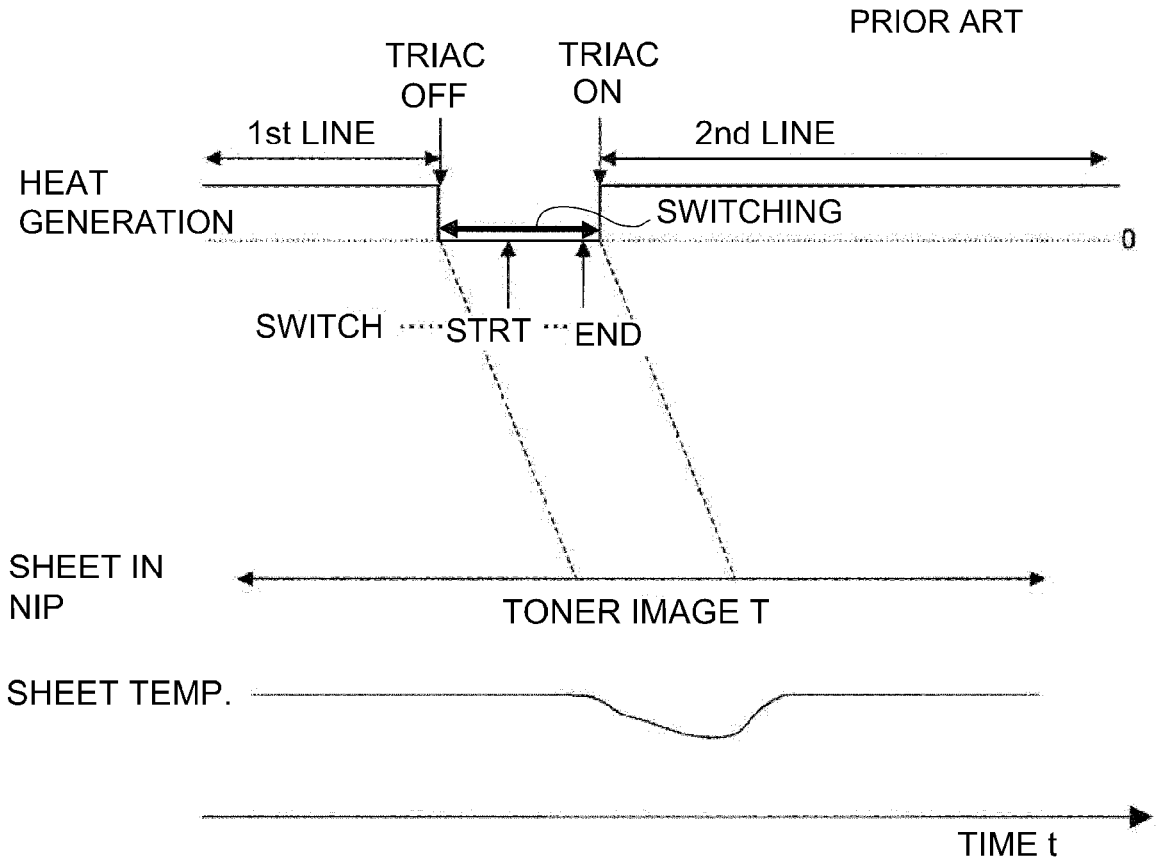

FIG. 14 is a schematic drawing for explaining the heat generation and heat conduction that occur in a conventional fixing apparatus, when the apparatus is switched in heat generation line.

Figure 15:
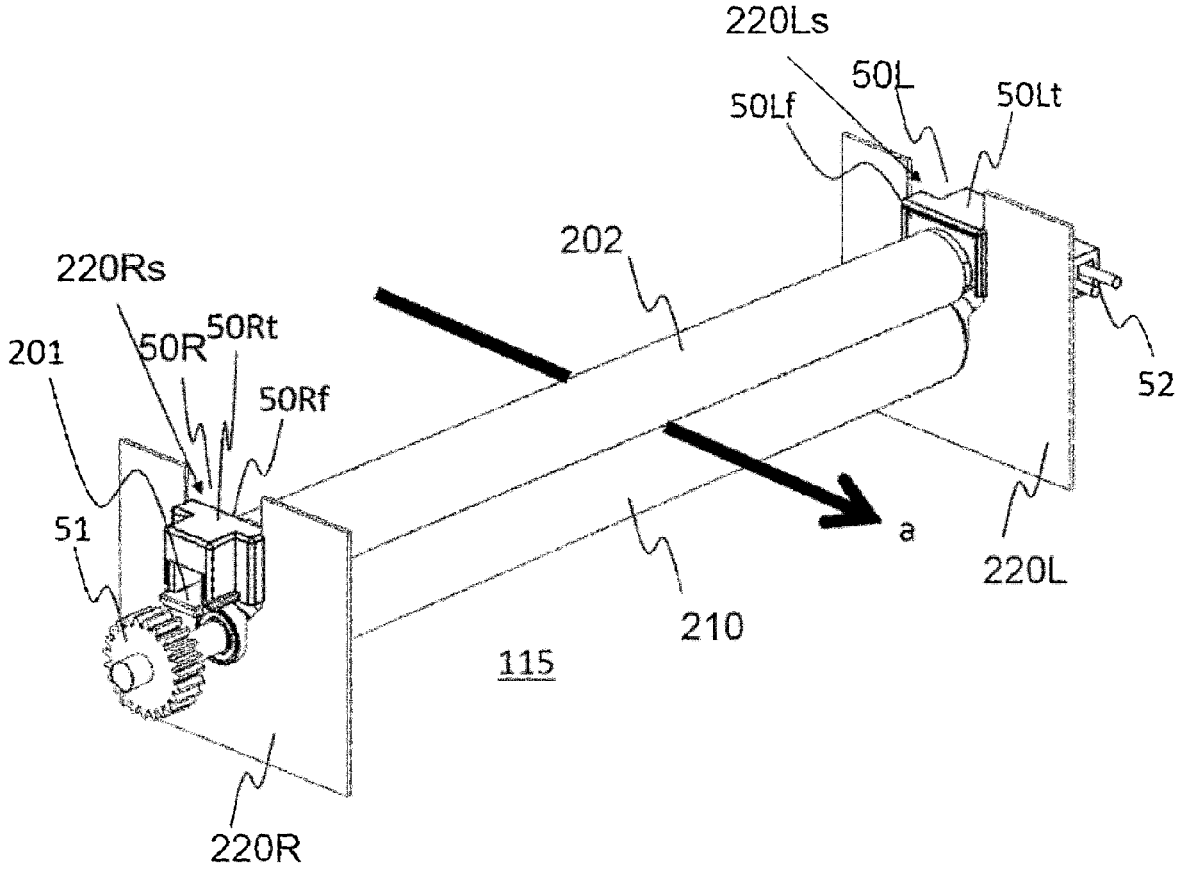

FIG. 15 is a perspective view of a typical fixing apparatus that is accordance with the present invention.

DESCRIPTION OF THE EMBODIMENTS

Hereafter, the present invention is described in detail with reference to a few of preferred embodiments of the present invention. The measurements, materials, shapes of the structural components of the image heating apparatuses, and the positional relationships among the components, in the following embodiments of the present invention, are to be changed, however, as necessary according to the structure of an image heating apparatus to which the present invention is applied, and also, the conditions under which the apparatus is used. That is, the following embodiments are not intended to limit the present invention in scope.

Embodiment 1

(1) Image Forming Apparatus Example

Figure 2:
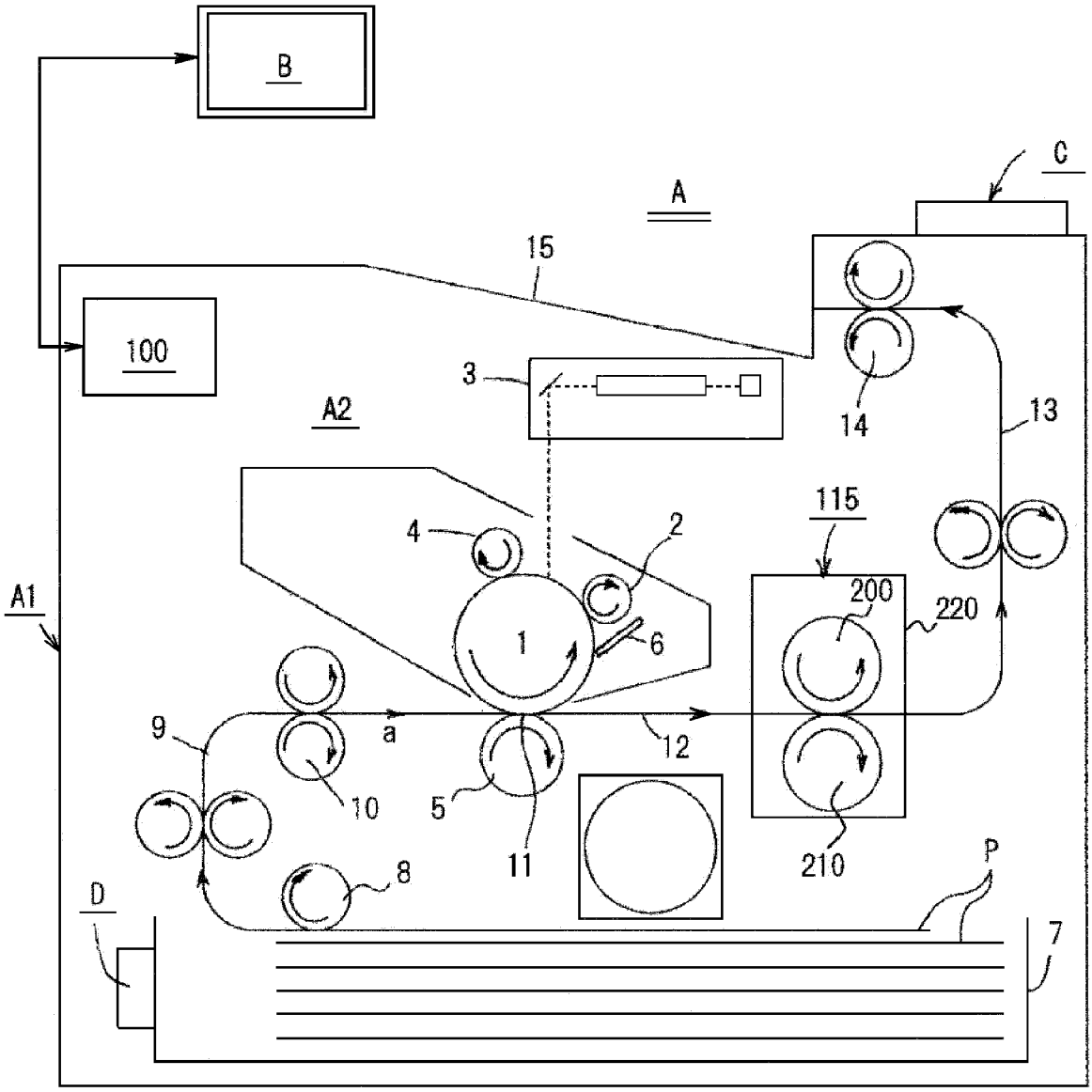
FIG. 2 is a schematic drawing of a typical image forming apparatus to which the present invention is applicable.

FIG. 2 is a schematic drawing of the image forming apparatus A in this embodiment. It shows the general structure of the apparatus. The image forming apparatus A is a laser printer, that is, an example of electrophotographic image forming apparatus. This image forming apparatus A is provided with an image forming portion A2, which is in the main assembly A1 of the apparatus A. It is structured so that the image forming portion A2 carries out an image forming operation (printing operation), based on the information (print command) of an image to be formed, which is input into a control portion 100 (controlling means) from an external apparatus B, such as a print server. That is, it forms a toner image on a sheet of recording medium P (which hereafter may be referred to simply as recording paper), and outputs the sheet as a print. A referential code M in FIG. 2 stands for a motor as a driving force source that drives various portions of the image forming apparatus A. The control portion 100 integrally controls the image forming apparatus A.

The image forming portion A2, which forms a toner image on a sheet P of recording paper, has a photosensitive drum 1 (which hereafter may be referred to simply as drum), as an image bearing member, which is rotationally driven at a preset process speed (peripheral velocity: 200 mm/sec, in this embodiment), in the counterclockwise direction indicated by an arrow mark. It has also a charge roller 2, a laser scanner unit 3, a development roller 4, a transfer roller 5, and a cleaner 6, which are the devices for processing the drum 1. Since the electrophotographic processes to be carried out by the image forming portion A2 are well-known, they are not described in detail here.

Sheets P of recording paper are held in layers in a cassette 7. As a feed roller 8 is driven with preset control timing, the sheets P are fed, one by one, into the main assembly A1 while being separated from the others. Then, each sheet P is conveyed through a sheet passage 9 to a pair of registration rollers 10. Then, it is introduced by the pair of registration rollers 10 into a transfer nip 11, which is formed by the drum 1 and a transfer roller 5, with preset control timing. Then, the sheet P is conveyed through the transfer nip 11. While the sheet P is conveyed through the transfer nip 11, a toner image is transferred from the drum 1 onto the sheet P. As the sheet P is conveyed out of the transfer nip 11, it is separated from the peripheral surface of the drum 1, conveyed through a sheet conveyance passage 12, and introduced into a fixing apparatus 115 (fixing portion) as an image heating apparatus. While the sheet P is conveyed through the fixation nip 11, the toner image on the sheet P is fixed to the sheet P by a combination of heat and pressure. After being conveyed out of the fixing apparatus 115 (fixing portion), it is conveyed through a sheet passage 13, and then, is discharged, as a print, onto the tray 15 by a pair of discharge rollers 14.

The width of the widest sheet P of recording paper that the image forming apparatus A in this embodiment can accommodate (which can be conveyed through image forming apparatus A) is 297 mm, which is equal to the length of the long edge of an A4 sheet of recording paper (when conveyed in landscape mode). Hereafter, this widest sheet P of recording paper is referred to as a "wide sheet", and a sheet P of recording paper that is narrower than the wide sheet is referred to as a "narrow sheet". Further, the apparatus A is structured so that each sheet P of recording paper is conveyed in such an attitude that the center of the sheet P coincides with the center line of the sheet passage of the apparatus A. That is, the apparatus A is structured so that when a sheet P of recording medium (paper) is conveyed through the main assembly A1 of the image forming apparatus A, the centerline of the sheet P, in terms of the direction perpendicular to the sheet conveyance direction, coincides with the centerline of the sheet conveyance passage, regardless of sheet width.

The information (width information) regarding the size of a sheet P of recording paper used for a given image forming operation is input into the control portion 100 from an external apparatus B, a control panel C of the image forming apparatus A, or a sheet width detecting means D, such as a sheet width sensor (unshown) with which the size regulation plate (unshown) of the cassette 7, sheet conveyance passage, or the like, is provided.

(2) Fixing Apparatus

Figure 3:
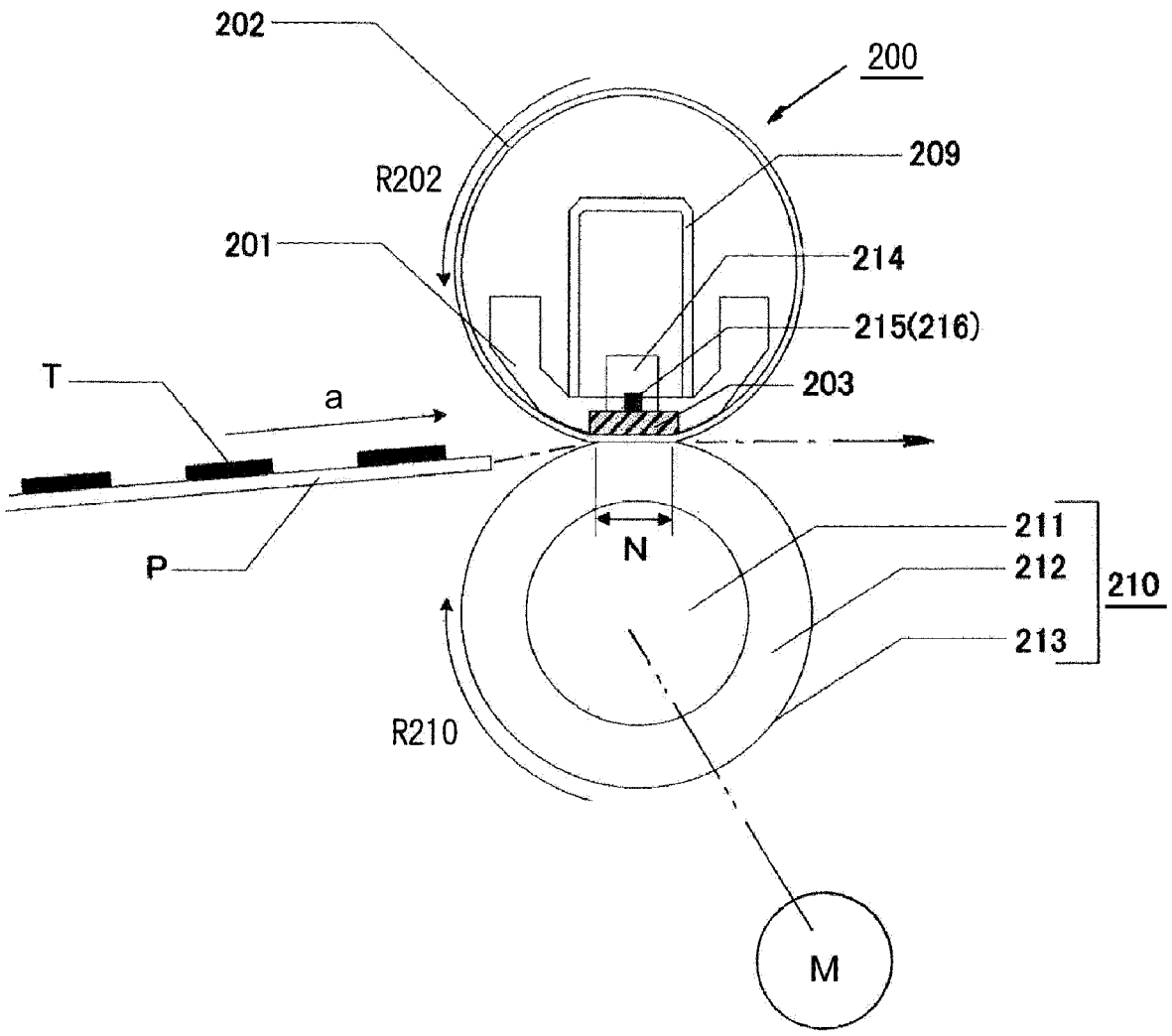
FIG. 3 is a schematic cross-sectional view of the essential portions of the fixing apparatus mounted in the image forming apparatus, such as the one shown in FIG. 2.

FIG. 3 is a schematic sectional view of the essential portions of the fixing apparatus 115 in this embodiment. This fixing apparatus 115 is structured so that its pressuring member is driven to heat a sheet P of recording paper and the toner image thereon with the use of a heating film (belt), which is tensionlessly held. FIG. 15 is a perspective view of the fixing apparatus 115.

Roughly explaining, this fixing apparatus 115 has a heating unit 200 having a fixation film 202, which is a cylindrical (endless) and flexible rotational member (movable member), a pressure roller 210 that is a backup member (pressure applying rotational member), and a frame 220 (FIG. 2) in which the preceding components are held.

The heating unit 200 is an assembly consisting of a film guide 201 as a guiding member, a ceramic heater 203 as a heating member (heat generating member) for heating the fixation film 202, a rigid stay 209 as a pressure applying member, and so on.

A pair of rotational members, more specifically, the fixation film 202 (which hereafter may be referred to simply as film) and pressure roller 210, form a nip N (fixation nip). The nip N is a portion of the fixing apparatus 115 through which a sheet P of recording paper, on which an unfixed toner image T is present, is conveyed while remaining pinched between the fixation film 202 and pressure roller 210, so that the toner image T is fixed to the sheet P by a combination of heat and pressure. The film 202 rotates through the nip N while remaining in contact with the sheet P, on which the image T is present. The film 202, pressure roller 210, heater 203, etc., make up a nip formation unit.

Film

The film 202 is made up of an endless substrative layer formed of a heat resistant resinous substance or a metallic substance, and a release layer formed on the outward surface of the substrative layer, of fluorinated resin, or the like, by coating, or a similar method. It is a thin, flexible, and thermally conductive member. It is elastic. Therefore, if it is left unattended, it remains roughly cylindrical.

As the material for the substrative layer, resinous substances (heat resistant resin film), such as polyimide, or metallic substances (metallic sleeve), such as stainless use steel (SUS), are usable. The release layer is provided to prevent the off-set phenomenon that toner temporarily adheres to the surface of the film 202, and then, transfers onto a sheet P of recording paper. As the material for the release layer, fluorine resins, such as polytetrafluoroethylene (PTFE), perfluoroalkoxy alkane (PFA), silicone resin, or the like, are usable.

Heater (Backup Member)

The heater 203 is a heat generating member. It is long, narrow, and thin, being, therefore, low in thermal capacity. Thus, it very quickly increases in temperature as electrical current is flowed through it. In this embodiment, it is a ceramic heater. The structure of this heater 203 is described later in Section (3).

Film Guide

The film guide 201 (which hereafter may be referred to simply as a guide) is such a member that holds the heater 203, and also guides the film 202 as the film 202 is rotated. The guide 201 is in the form of a trough that is roughly semicircular in cross section. It is a long and narrow member, and is thermally insulative. It is formed of a heat resistant resin, such as poly-carbonate. It is positioned so that its lengthwise direction is parallel to the lengthwise direction of the film 202. The heater 203 is held by the outward side of this guide 201, by being embedded in a long and narrow groove (seating groove) made in the outward surface portion of the guide 201 so that it extends in the lengthwise direction of the guide 201.

Rigid Stay

The rigid stay 209 (which hereafter may be referred to simply as a stay) also is a long and narrow member. It is positioned so that its lengthwise direction is perpendicular to the lengthwise direction of the film 202. It is such a member that is positioned to catch the reactional force from the pressure roller 210. Thus, it is desired to be formed of a substance that is unlikely to deform, even when it is subjected to a large amount of pressure. In this embodiment, it is shaped so that its cross section looks like an inverted letter U. It is formed of SUS 304. It is positioned so that it is on the center portion of the upwardly facing surface (opposite side from heater 203) of the guide 201, and extends in the lengthwise direction of the guide 201.

The film 202 is loosely fitted around an assembly consisting of the aforementioned guide 201, the heater 203, and the stay 209. The lengthwise end portions (front and rear portions) of the guide 201, and those of the stay 209, are protrusive from the lengthwise ends (openings) of the film 202, one for one, and are fitted with end members 50L and 50R, respectively.

The end members 50L and 50R are regulating members for regulating the movement of the film 202 in the lengthwise direction of the heating unit 200, and the shape of the film 202 in a plane that is perpendicular to the lengthwise direction of the heating unit 200. The film 202 is between a pair of flanges 50Lf and 50Rf, which oppose the end members 50L and 50R. The end members 50L and 50R are provided with pressure bearing portions 50Lt and 50Rt, respectively. As the film 202 slides in its widthwise direction, one of the edges of the film 202 comes into contact with the flanges 50Lf or 50Rf, regulating thereby the movement of the film 202.

Pressure Roller

The pressure roller 210 has a core shaft 211 formed of aluminum, iron, stainless steel, or the like, and an elastic layer 212 formed of an elastic and heat resistant substance, such as silicone rubber, in the form of a cylindrical roller, in a manner to fit around the peripheral surface of the core shaft 211, and to allow the end portions of the core shaft 211 to extend beyond the lengthwise ends of the elastic layer 212 and function as the portions by which the pressure roller 210 is supported. It is also provided with a release layer 213 formed on the outward surface of the elastic layer 212, of a substance that contains fluorinated resin, for such reasons as enabling the pressure roller 210 to efficiently convey a sheet P of recording paper, film, or the like, and preventing the pressure roller 210 from being soiled by toner, and/or the like substances.

The pressure roller 210 is supported between the side plates 220L and 220R of the frame 220 (FIG. 2) of the image forming apparatus A. More specifically, the lengthwise end portions of the pressure roller 210, in terms of the lengthwise direction of the frame 220, are rotatably supported by a pair of bearings with which the side plates 220L and 220R are provided, one for one. Further, the heating unit 200 is positioned between the side plates 220L and 220R, practically in parallel to the pressure roller 210, in such a manner that the side of heating unit 200, which has the heater 203, faces the pressure roller 210. The end members 50L and 50R of the heating unit 200 are fitted in a pair of guides 220Ls and 220Rs with which the side plates 220L and 220R are provided, in such a manner that they are allowed to slide toward, or away from, the pressure roller 210.

The end members 50L and 50R catch, by their pressure bearing portions 50Lt and 50Rb, a preset amount of pressure generated by a pressure application mechanism (unshown) toward the pressure roller 210. Thus, the entirety of each of the end members 50L and 50R, the stay 209, the guide 201, and the heater 203 is pressed toward the pressure roller 210. Therefore, the combination of the heater 203 and the guide 201 is pressed against the elasticity of the elastic layer of the pressure roller 210 by the preset amount of pressure, with the presence of the film 202 between the heater 203 and the pressure roller 210. Thus, the elastic layer 212 is elastically deformed in the direction in which it is pressed by the heater 203, forming thereby the nip N that has a preset amount of width in terms of the direction parallel to the recording paper conveyance direction a, between the film 202 and pressure roller 210.

In this embodiment, the heater 203 is positioned so that it remains in contact with the inward surface of the film 202, and functions as a nip forming member for forming the nip N by pinching the pressure roller 210 and the film 202. By the way, the heater 203 is made to generate heat by the electrical power supplied thereto by way of a cable 52.

Fixing Operation

The control portion 100 rotationally drives the motor M in response to a print command. The rotation of the output shaft of the motor M is transmitted to a driving gear 51, with which one of the lengthwise end portions of the metallic core 211 of the pressure roller 210 is provided. Thus, the pressure roller 210, which is as a rotational driving member, rotates at a preset process speed (peripheral velocity) in the clockwise direction indicated by an arrow mark R210 in FIG. 3. In this embodiment, the pressure roller 210 rotates at 200 mm/sec of process speed.

The rotational force from the pressure roller 210 is transmitted to the film 202 by the friction between the peripheral surface of the pressure roller 210 and the outward surface of the film 202, in the nip N. Thus, the film 202 rotates around the combination of the heater 203, the guide 201, and the stay 209, in the direction indicated by an arrow mark R202, at a peripheral velocity that is roughly equal to the peripheral velocity of the pressure roller 210, remaining in contact with the protective layer 208 (which will be described later), that is, the surface layer, of pressure roller 210, by its inward surface. Further, after the control portion 100 starts supplying the heater 203 with electrical power, it raises the temperature of the heater 203 to a target level that enables the fixing apparatus 115 to perform a fixing operation, and controls the power supply so that the temperature of the pressure roller 210 remains at the target level. The control circuit for driving the heater 203 will be described later in Section (4).

As the state of the fixing apparatus 115 changes into the one described above, a sheet P of recording paper that is bearing an unfixed toner image is introduced into the fixing apparatus 115 from the direction of the transfer nip 11, and is conveyed through the nip N while remaining pinched between the film 202 and the pressure roller 210. While the sheet P is conveyed through the nip N, the heat from the heater 203 is given to the sheet P and the unfixed toner image thereon, through the film 202. Thus, the unfixed toner image T is melted by the heat from the heater 203, and is fixed to the sheet P by the pressure in the nip N.

(3) Structure of Heater

Part (a) of FIG. 4 is a schematic top view of the top side of the heater 203. Part (b) of FIG. 4 also is a schematic top view of the heater 203. In part (b) of FIG. 4, however, the protective layer 208, or the surface layer, of the heater 203, is not shown to show the first and second heat generating members 207 and 204. Part (c) of FIG. 4 is a schematic top view of the back side of the heater 203. Part (d) of FIG. 4 is an enlarged schematic cross-sectional view of the heater 203, at a plane indicated by a pair of arrow marks (d) in part (c) of FIG. 4.

This heater 203 is a ceramic heater. It is in the form of a long, narrow, and thin piece of plate, being, therefore, low in thermal capacity. Thus, it quickly increases in temperature as it is supplied with electrical power. It has a long, narrow, and thin substrative plate 206 (which hereafter may be referred to simply as substrate) formed of ceramic, such as alumina, aluminum nitride, and the like. Hereafter, one of the primary surfaces of this heater substrate 206 is referred to as a top surface, whereas the other surface is referred to as a bottom surface.

The heater 203 is provided with the first heating member 207 and second heating member 204, which are heat generating resistors. Both the first and second heating members 207 and 204 are positioned on the top surface of the heater substrate 206 in such a manner that their lengthwise directions are parallel to the lengthwise direction of the heater substrate 206, being, therefore, parallel to each other, with the presence of a preset amount of gap between the two heating members 207 and 204 in terms of the widthwise direction of the heater substrate 206.

The first and second heating members 207 and 204 are made different in heat generation range (effective heat generation length). The size of the widest sheet P of recording paper usable by (conveyable through) the image forming apparatus A in this embodiment is A3 (297 mm in landscape mode) as described above. Thus, the first heating member 207 is given a heat generation range of 300 mm (heat generation range A), which is wide enough to thermally fix a toner image on the widest sheet P of recording paper. The second heating member 204 is given a heating range of 222 mm (heating range B) for thermally fixing a toner image on a narrow sheet of recording paper (210 mm (A4 size in portrait mode) or 216 mm (legal size in portrait mode)).

The first and second heating members 207 and 204 are formed on heater substrate 206 by coating one (top surface) of the primary surfaces of the heater substrate 206 with an electrically resistant substance, such as silver palladium (AgPd), by screen printing, or a similar method, in such a manner that the members 207 and 204 extend in the lengthwise direction of the heater substrate 206. As described above, the image forming apparatus A in this embodiment is structured so that when a sheet P of recording paper is conveyed in the apparatus A, the center of the sheet P coincides with the widthwise center of the sheet passage. In parts (a) and (b) of FIG. 4, S stands for a referential line (hypothetical line) for recording sheet conveyance. Further, the image forming apparatus A is structured so that the first and second heating members 207 and 204 are symmetrically positioned with reference to the referential line S.

One of the lengthwise end portions of the top surface of the heater substrate 206 is provided with a pair of electrically conductive patterns (electrical power supply electrodes) 323 and 324 that are in connection to the first and second heating members 207 and 204, respectively. The other is provided with an electrically conductive pattern 326 (power supply electrode) that is in connection to both the first and second heat generating members 207 and 204. These electrically conductive patterns 323, 324, and 326 are formed by coating the heater substrate 206 with an electrically conductive substance, such as silver (Ag), with the use of screen printing, or a like method.

Further, the heater 203 is provided with a glass coat layer 208 formed as a protective layer on the heater substrate 206 by coating the top surface of the heater substrate 206 with glass, or a like substance, in a manner to cover the entirety of the first and second heating members 207 and 204, and parts of the electrically conductive patterns 323, 324, and 326.

Further, the heater 203 is provided with a pair (first and second) of temperature detecting members 215 and 216, which are positioned on the bottom surface of the heater substrate 206, to detect the temperature of the heater 203. The temperature detecting members 215 and 216 are thermistors, for example. Moreover, the heater 203 is provided with a protective element 214, which is a means for preventing the heater 203 from excessively increasing in temperature. The protective member 214 is positioned on the bottom surface of the heater substrate 206. It is a thermal fuse or a thermal switch, for example.

The first temperature detecting member 215 is positioned on the lengthwise center portion of the bottom surface of the heater substrate 206 to control the heater 203 in temperature. It is kept pressed on the heater substrate 206 by a preset amount of pressure generated by a spring (unshown), or the like. Hereafter, this first temperature detecting member 215 is referred to as a temperature control thermistor. The second temperature detecting member 216 is positioned on one of the lengthwise end portions of the bottom surface of the heater substrate 206 to monitor the temperature of the end portion of the heater 203. It is kept pressed upon the lengthwise end portion of the bottom surface of the heater substrate 206 by a preset amount of pressure generated by a spring (unshown), or the like. Hereafter, this second temperature detecting member 216 is referred to as an end portion temperature monitoring thermistor.

(4) Circuit for Controlling Driving of Heater, and Control Sequence

FIG. 5 shows the structure of the circuit for controlling the driving of the heater 203. In FIG. 5, a referential number 322 stands for a temperature controlling portion made up of a central processing unit (CPU), and memories, such as a read only memory (ROM) and a random access memory (RAM). This temperature controlling portion 322 is a part of the control portion 100. In the memories, various programs necessary to control the heater 203 in temperature are stored. A referential number 301 stands for a commercial alternating current (AC) power source that is connected to the image forming apparatus A.

The temperature control portion 322 makes the first heat generating member 207 or the second heat generating member 204 generate heat by supplying the heat generating member 207 or 204 with electrical power from the AC power source 301 with preset control timing. As the first heat generating member 207 is supplied with electrical power, it quickly generates heat across its heat generation range 207-A. As the second heat generating member 204 is supplied with electrical power, it quickly generates heat across its heat generation range 204-B.

Referring to FIG. 5, the circuit for controlling the driving of the heater 203 has shared power supply controlling means 302 to 308 for controlling the power supply to the heat generation lines that supply the first heating member 207 with electrical power to make the first heating member 207 generate heat, and supply the second heat generating member 204 with electrical power to make the second heat generating member 204 generate heat.

More concretely, the electrical power to be supplied to the heating generating member 207 or second heat generating member 204 is controlled (turned on or off) by a shared triac 302 (bidirectional thyristor). Resistors 303 and 304 are bias resistors for the triac 302. A photo-triac coupler 305 has a photo-transistor 305*a* and a light emitting diode 305*b*. It supplies the light emitting diode 305*b* with electrical power to turn on the triac 302.

The resistor 306 is for controlling the light emitting diode 305*b* in the amount of electrical current. It turns on or off the photo-triac coupler 305 with the use of the transistor 307, which reacts to a heater driving signal output from the temperature control portion 322 by way of the resistor 308.

Further, the circuit, in FIG. 5, for controlling the driving of the heater 203 has a pair of heating line switching means 707 and 708 for switching the heat generation line between the first and second lines. In this embodiment, a double throw switching relay 707 is used to switch between the first and second heat generating members 207 and 204. The relay 707 is under the control of a transistor 708 that reacts to relay driving signals output by the temperature control portion 322. As the contact point 707*a* of the relay 707 is connected to the contact point 707*c*, the heating member 207 is supplied with electrical power, whereas as the contact point 707*a* is connected to the contact point 707*b*, the second heat generating member 204 is supplied with electrical power.

In order to prevent the problem that when the contact point 707*a* of the relay 707 is switched in point of connection, the point 707*a* of contact becomes welded to the point 707*c* of contact or the point 707*b* of contact, due to electrical discharge (arcing). The temperature control portion 322 is structured so that, after it is ensured that the triac 302 was turned off, and the power supply is gone, the relay 707 is changed in point of connection. In this embodiment, the length of time that is allowed to elapse from when the triac 302 is turned off to when it becomes possible for the triac 302 to be turned on is set to 100 msec. The detailed description of the control of the operation for switching between the first and second heat generating members 207 and 204 will be given later.

The temperature detected by the thermistor 215 (216) is output as a partial voltage divided between the resistor 321*a* (321*b*) and the thermistor 215 (216), in the form of an analog signal. This analog signal is converted into a digital signal by an analog/digital (A/D) conversion circuit (unshown), and is input as temperature information into the temperature control portion 322.

The temperature control portion 322 obtains the duty with which electrical power is to be supplied, based on the temperature value detected by the temperature control thermistor 215, and the temperature level (target temperature level set to thermally fix unfixed toner image to sheet of recording paper through film 202), by proportional integral (PI) control, for example. Further, the temperature control portion 322 converts the duty of the electrical power to be supplied into a phase angle or a frequency, which is proportional to the duty, or frequency, which is set for the heater 203. Then, the temperature control portion 322 outputs a heater driving signal that corresponds to the control level. In this embodiment, the target temperature level for the heater 203 is set to 200° C.

Further, the temperature control portion 322 monitors the temperature of the portion of the heater 203 that is out of the sheet path. The protective element 214 is positioned in the power supply line between the AC power source 301 and the electrically conductive pattern 326 of the heater 203. If the heater 203 goes out of control in temperature, and the protective element 214 reaches the preset temperature level, the protective element 214 opens to interrupt the power supply to the heater 203.

FIG. 6 is a flowchart of the control sequence for the heater 203 in this embodiment. The width of a sheet P of recording paper is detected in step S2. If an image forming operation for continuously forming images on sheets P of recording paper of the size A4 is detected, in step S2, as the sheets P are conveyed in the portrait mode, first, the point 707*a* of contact of the switching relay 707 is connected to the point 707*c* of contact of the relay 707 to form the first heating line that enables the heating member 207 to be supplied with electrical power (step S3).

The temperature control portion 322 outputs a heater driving signal to the transistor 307 to turn on the photo-triac coupler 305, in order to turn on the triac 302 (step S4). As the triac 302 is turned on, electrical power is supplied to the heating member 207 from the commercial power source 301 through the electrically conductive patterns 323 and 326. Thus, the heating member 207 begins to generate heat, causing the heater 203 to quickly increase in temperature. The temperature control portion 322 turns the transistor 307 on or off to maintain the temperature of the heater 203 at the preset level, based on the temperature information from the temperature control thermistor 215.

Further, while the control portion 100 is rotationally driving the motor M, and the heating member 207 is being supplied with electrical power, a sheet P of recording paper of the size A4, on which an unfixed toner image T is present, is introduced into the nip N in the portrait mode, with its toner image bearing surface facing upward. Then, the sheet P is conveyed through the nip N by the coordination of the outward surface of the film 202 and the peripheral surface of the pressure roller 210, while remaining pinched by the film 202 and pressure roller 210.

While the sheet P is conveyed through the nip N, the toner image T on the sheet P is heated by the heater 203 through the film 202. Thus, the toner image T is thermally fixed to the surface of the sheet P by the pressure in the nip N. After the thermal fixation of the toner image T to the sheet P, the sheet P is discharged from the nip N, and then, is conveyed toward a sheet conveyance passage 13.

While multiple sheets P of recording paper are continuously conveyed through the fixing apparatus 115, the temperature control portion 322 continuously monitors the value of the temperature detected by the thermistor 216 for monitoring the lengthwise end portion of the heater 203 (step S5). As the sheets P are continuously conveyed through the nip N, the out-of-sheet-path portions of the nip N (heater 203) gradually increases in temperature. If the temperature detected by the thermistor 216 for monitoring the lengthwise end portion of the heater 203 exceeds a preset threshold value, the temperature control portion 322 determines (obtains) the switching timing (t-off-on), which will be described next. Here, that the temperature detected by the thermistor 216 exceeds a preset value means that the temperatures of the internal members of the fixing apparatus 115 are nearing the upper limit of the temperature range tolerable to the members. It does not mean, however, that the internal temperature of the fixing apparatus 115 immediately becomes intolerable to the internal members of the fixing apparatus 115.

After the timing with that the temperature detected by the thermistor 216 exceeded the threshold value described above, the temperature control portion 322 compares the timing with which the portions of a sheet P of recording medium, which has no image (portion of sheet P of recording medium on which toner image is not present, or physical sheet interval between two sheets P of recording paper, which are being consecutively conveyed) reaches the nip N, and the length of time it takes for the image-less portion of the sheet P to pass a given portion (nip N, for example) of the fixing apparatus 115, with the length of time it takes for heat to conduct from the heating member to the nip N. Then, it determines the switching timing (t-off-on) by calculating the point in time at which the triac 302 is to be turned off and on, in order to ensure that the heat conduction during this period stays within the period in which the image-less portions of the sheet P or the sheet interval moves through the nip N (step S6).

Then, the temperature control portion 322 waits until the point in time determined in step S6 (step S7). Then, it turns off the triac 302 (step S8), disconnects the point 707*a* of contact of the relay 707 from the point 707*c* of contact, and connects the point 707*a* of contact to the point 707*b* of contact to form the second heat generation line (step S9). That is, it forms a heat generation line that makes it possible to supply the second heat generating member 204 with electrical power. Then, it turns on the triac 302 (step S10). The length of time required for steps S8 to S10 is 100 ms as described above.

If the temperature detected by the temperature monitoring thermistor 216 exceeds the threshold value after the switching of the point of connection, the sheet interval is extended (step S15) to continue the on-going printing job until the last print is output (step S16).

Further, if it is detected by the sheet size (width) detecting means in step S2 that the sheet P of recording paper that is being fed into the main assembly A1 of the image forming apparatus A is a wide sheet P of recording paper, the first heat generation line, which is capable of supplying the first heating member 207 with electrical power, is enabled, like in step S3 (step S12). Further, the temperature control portion 322 makes the first heating member 207 generate heat by supplying the first heating member 207 with electrical power, and controls the heater 203 in such a manner that the temperature of the heater 203 remains at the preset level, like in step S4 (step S13). Then, it makes the image forming portion A2 continuously form images on wide sheets P of recording paper. If the temperature detected by the temperature monitoring thermistor 216 exceeds the preset level (step S14), the temperature control portion 322 increases the image forming apparatus A in sheet interval, or takes a like measure (step S15). Then, it makes the image forming apparatus A continue the printing job until the job is completed (step S16).

As described above, the temperature control portion 322 sets the switching timing so that the effects of the reduction in heater temperature that occurs while the triac 302 is turned on and off (period in which the point 707*a* of contact of the relay 707 is switched in connection, that is, the period in which heater is supplied with no electrical power) do not appear across the toner image T on a sheet P of recording paper.

Figure 1:
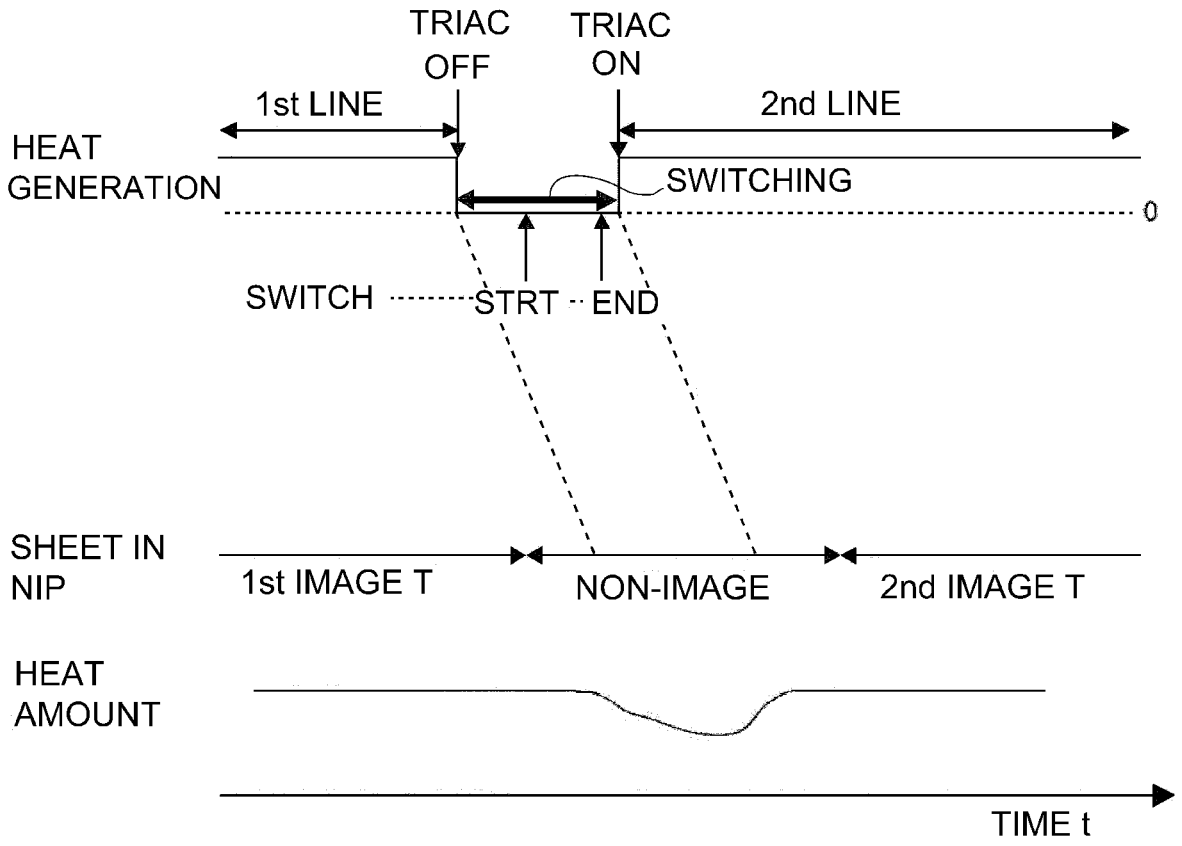
FIG. 1 is a schematic drawing for explaining the heat generation and heat conduction that occur in the fixing apparatus in the first embodiment of the present invention, when the apparatus is switched in heat generation line.

FIG. 1 schematically shows the manner in which heat is generated by the heater 203 and the generated heat conduction in the fixing apparatus 115 in this embodiment, when the fixing apparatus 115 is switched in heat generation line. There is a certain amount of time lag between the timing with which the electrical power is supplied to the heater 203, and the timing with which the heat generated by the heater 203 conducts to the nip N. The broken lines in FIG. 1 show the time lag. As is evident from FIG. 1, the temperature control portion 322 sets the timing for the switching of the point of connection so that the effects of the temperature drop that occurs during the switching of the point of connection appears in the nip N while no sheet P of recording paper is in the nip N, or while the image-less portion of the sheet P is in the nip N, as shown in FIG. 1. As long as a fixing apparatus (image forming apparatus A) is controlled like the fixing apparatus 115 in this embodiment, it does not occur that the period in which the amount by which heat is generated by the heater 203 temporarily drops due to the switching of the heat generation line, coincides with the period in which the portion of a sheet P of recording medium, on which a toner image is present, is in the nip N.

This can be confirmed by obtaining the profile of the surface temperature of a given point (on the upstream side, for example, of the nip N, in terms of direction of film rotation) of the film 202, by measuring the temperature of this point with the use of a temperature measuring device, such as an infrared thermography, and then, comparing the timing with which the area of the film 202, which fell in surface temperature due to the drop in the amount of heat generation, reaches the nip N, with the timing with which the toner image T on a sheet P of recording paper moves through the nip N, or the timing with which the sheet p moves through the nip N.

As described above, in the case of a fixing apparatus, such as the one in this embodiment, which is structured so that it can be switched in heat generation line during a printing job, the problem that a toner image on a sheet P of recording medium is unsatisfactorily fixed due to the fluctuation in the temperature of the heating means can be prevented with the use of the method, in this embodiment, for controlling the heating unit 200, described above.

By the way, in this embodiment, the heating unit 200 was provided with two heating lines, more specifically, the first and second lines. This embodiment, however, is not intended to limit the present invention in scope. For example, the present invention is also applicable to a fixing apparatus that has three or more heat generation lines, and that is structured so that at least two of them can be switched in their connection to the power supply. That is, the present invention is effectively applicable to any fixing apparatus as long as the apparatus is structured to be compatible with the technical concept of the present invention.

Further, a fixing apparatus may be structured so that the period in which its heating means drops in the amount of its heat generation coincides with the period in which no sheet P of recording paper is moving through the nip N.

Further, in this embodiment, the heater 203 was provided with the heat generating members 207 and 204, which are different in length. This embodiment, however, is not intended to limit the present invention in scope. That is, the present invention is also applicable to a fixing apparatus that has two or more heat generating members that are the same in length, but are different in electrical resistance, and that is structured so that it is switchable in heat generating member.

Moreover, in this embodiment, the heating members were formed on the ceramic substrate. This embodiment is not, however, intended to limit the present invention in scope. That is, the present invention is also applicable to a fixing apparatus having a heater, the substrative layer of which is formed of heat resistant resin, such as polyimide, or a metallic substance, such as SUS.

Further, in this embodiment, the heater was made up of a ceramic substrate, and heat generating members formed on the nip side surface of the substrate. That is, it is of the so-called top surface heat generation type. The technical concept of the present invention is also applicable, however, to a heater of the so-called bottom surface heat generation type, that is, a heater made up of a substrate, and heat generating members from on the opposite surface of the substrate from the nip.

Embodiment 2

The characteristic feature of the heater of the fixing apparatus in the second embodiment of the present invention is that it is structured so that both the top and bottom surfaces of its substrate are provided with heat generating members, and also, so that the heaters are different in the heat generation amount distribution in terms of their lengthwise direction. Further, its heater driving circuit is structured so that the heat generating member formed on one of the two surfaces of the heater substrate, and the heat generating member formed on the other surface, can be switched in operation with the use of the switching relay, and also, the two heat generating members are driven by a triac that is shared by the two members.

Part (a) of FIG. 7 is a schematic vertical sectional view of the heater 403 in the second embodiment, at a vertical plane that is perpendicular to the lengthwise direction of the heater 403 and coincides with the lengthwise center of the heater 403. Part (b) of FIG. 7 is a schematic top view of the top surface of the heater 403. Part (c) of FIG. 7 is a schematic top view of the bottom surface of the heater 403.

The heater 403 has heat generating members 700 and 701 for a wide sheet P of recording paper, and a heater substrate 406, which holds the heat generating members 700 and 701 on its top surface. The heat generating members 700 and 701 are 303 mm in length and are positioned parallel to the lengthwise direction of the heater substrate 406. These heat generating members 700 and 701 are shaped so that they are not uniform in width in terms of their lengthwise direction. That is, the two heat generating members 700 and 701 are different in shape.

More specifically, the heat generating member 700, that is, one of the two heat generating members 700 and 701, is referred to as the first heating member (which hereafter will be referred to as main heat generating member). It is designed so that the closer it is to the center of the heater substrate 406 in terms of the lengthwise direction of the substrate 406, the narrower the heat generating member 700 is. In the case of the heat generating member 701, or the other of the two heat generating members, is designed so that the closer it is to the center of heater substrate 406 in terms of the lengthwise direction of the heater substrate 406, the wider the heat generating member 701 is. It may be referred to as the second heat generating member (which hereafter may be referred to as subordinate heat generating member (sub-heat generating member)). This subordinate heat generating member 701 and main heat generating member 700 are positioned side by side on the substrate 406. This heat generating member for a wide sheet P of recording paper, which consists of the main heating member 700 and subordinate heating member 701, is positioned so that its one half is symmetrical to the other with reference to the line that is perpendicular to the heater substrate 406 and coincides with the lengthwise center of the heater substrate 406.

Further, the heater 403 is provided with an electrically conductive pattern 705 (power supply electrode) shared by the main heating member 700 and the subordinate heating member 701. The electrically conductive pattern 705 is on one of the lengthwise ends of the heater substrate 406. It is formed on the top surface of the heater substrate 406 by screen printing, or a like method. Further, the heater 403 is provided with an electrically conductive pattern 703 (power supply electrode) for the main heating member 700, and an electrically conductive pattern 704 (power supply electrode) for the subordinate heating member 701, which is on the other lengthwise end of the heater substrate 406. The electrically conductive patterns 703 and 704 also are formed by screen printing, or a like method.

Further, the heater 403 is provided with a heating member 702, as the third heating member, for a narrow sheet P of recording paper. The heating member 702 is 222 mm in length, and is positioned on the bottom surface of the heater substrate 406, in such a manner that its lengthwise direction is parallel to the lengthwise direction of the heater substrate 406. The heating member 702 for a narrow sheet P of recording paper is positioned so that one half of the heating member 702 is symmetrical to the other half with reference to the line that is perpendicular to the lengthwise direction of the heater substrate 406 and coincides with the lengthwise center of the heater substrate 406. Further, the heating member 702 for a narrow sheet of paper is designed so that it is narrowest at its lengthwise center, and gradually increases in width toward its lengthwise ends.

Moreover, the heater 403 is provided with a pair of electrically conductive patterns 705 and 706 (power supply electrodes) for the heating member 702 for a narrow sheet of paper, which are positioned on one of the lengthwise ends of the bottom surface of the heater substrate 406. The two patterns 705 and 706 also are formed by screen printing, or a like method. The electrically conductive pattern 705 is in electrical connection to the electrically conductive pattern 705 on the top surface of the heater substrate 406, by way of an electrically conductive pattern (unshown) in a through hole with which the heater substrate 406 is provided.

Further, like the heater 203 in the first embodiment, the heater 403 is provided with a pair of thermistors 215 and 216 (which are unshown in FIG. 7) for detecting the temperature of the heater 403. The thermistors 215 and 216 are positioned on the bottom surface of the heater substrate 406. More specifically, they are on a glass coat layer 405 on the bottom surface of the heater substrate 406. The temperature control thermistor 215 is kept pressed on the lengthwise center portion of the glass coat layer 405 by a preset amount of pressure generated by a spring (unshown), or the like. The thermistor 216 for monitoring the temperature of one of the lengthwise end portions of the heater 403 is kept pressed on the adjacencies of one of the lengthwise ends of the glass coat layer 405 by a preset amount of pressure generated by a spring (unshown), or the like.

Moreover, like the heater 203 in the first embodiment, the heater 203 is provided with a protective element 214 (which is not shown in FIG. 7) as a means for preventing an excessive increase in temperature. The protective element 214 is positioned on the glass coat layer 405. It is a thermal fuse or a thermal switch, for example.

FIG. 8 shows the distribution of the amount by which heat is generated by the main heating member 700, by the subordinate heating member 701, and that by the heating member 702 for a narrow sheet of paper, in terms of the lengthwise direction of the heating members. As is evident from FIG. 7, the main heating member 700 is such a heat generating member that is greatest in the amount of heat generation at its lengthwise center, and gradually reduces in the amount of heat generation toward the lengthwise ends. The subordinate heating member 701 is such a heat generating member that is the least in the amount of heat generation at its center in terms of its lengthwise direction and gradually increases in the amount of heat generation toward its lengthwise ends. The heat generating member 702 for a narrow sheet of paper is such a heat generating member that falls within the lengthwise ranges of the heat generating members 700 and 701, is the least in the amount of heat generation at its lengthwise center, and gradually increases in the amount of heat generation toward its lengthwise ends.

Thus, the main heating member 700 and the subordinate heating member 701 can be controlled to give an optional inclination to the distribution of the amount by which heat is generated by the heater 403, in terms of the lengthwise direction of the heater 403. Therefore, it is possible to prevent the out-of-sheet-path portions of the nip N (fixing apparatus 115) from excessively increasing in temperature when a substantial number of sheets P of paper that are wider than the heating member 702 for a narrow sheet of paper, but narrower than the widest sheet of paper conveyable through the nip N (no narrower than 216 mm, and no wider than 297 mm, in this embodiment) are used as a recording medium.

Further, the heating member 702 for a narrow sheet of paper, and the subordinate heating member 701, can be independently controlled from each other to prevent the out-of-sheet-path portions of the nip N (fixing apparatus 115) from excessively increasing in temperature when a substantial number of sheets of recording paper that are narrower (no wider than 216 mm, in this embodiment) than the heating member 702 for a narrow sheet of paper, are used as a recording medium.

FIG. 9 shows the structure of the circuit for driving (controlling) the heater 403 in this embodiment. Here, the portions of the heater driving (controlling) circuit in this embodiment that are similar in structure to the counterparts in the first embodiment are given the same referential codes as those given to the counterparts, and are not described. In this embodiment, a double throw switching relay 707 is used to switch between the main heating member 700 as the heating member for a wide sheet of recording paper, and the heating member 702 as the heating member for a narrow sheet of recording paper. The switching sequence in this embodiment is similar to that (FIG. 6) in the first embodiment.

In a case in which a wide sheet of recording paper is used for a printing operation, the switching relay 707 is connected to the main heating member 700 so that the main heating member 700 and the subordinate heating member 701 can be used in combination to control the ratio with which electrical power is supplied for the printing operation.

In a case in which a narrow sheet of recording paper is used for a printing operation, first, the switching relay 707 is connected to the main heating member 700 side as in the first embodiment, so that the main heating member 700 and subordinate heating member 701 can be used in combination for a printing operation. If the temperature detected by the end temperature monitoring thermistor 216 exceeds a preset value, such timing that the period in which the heater 403 temporarily falls in the amount of heat generation as it is switched in heat generating member is determined. Then, the triac 302 is turned off with the determined timing. Then, the connection of the switching relay 707 is switched to the heating member 702 for a narrow sheet of recording paper to turn on the triac 302.

Thereafter, a printing operation is carried out while controlling the heater 403 in power supply ratio by the combination of the heat generating pattern 702 for a small sheet of recording paper and the subordinate heating member 701.

FIG. 10 schematically shows the heat generation and heat conduction, which occur as the fixing apparatus in this embodiment is switched in heat generation line. In this embodiment, the heating unit 200 is switched in heat generating member from the one on the top surface of the heater substrate 406 to the one on the bottom surface of the heater substrate 406. Therefore, when the switching timing is determined, the length of time it takes for heat to conduct through the heater substrate has to be taken into consideration. Referring to FIG. 10, in this embodiment, it does not occur that the period in which the heater 403 temporarily falls in the amount of heat generation during the switching of the heat generation line coincides with the period in which the image portion of a sheet of recording paper moves through the nip N (fixing apparatus). Therefore, it does not occur that the toner image on a sheet P of recording paper is insufficiently heated. In other words, the problem related to unsatisfactory fixation can be avoided.

Embodiment 3

The fixing apparatus in this embodiment is another example of a fixing apparatus that is in accordance with the present invention. The apparatus has a radiant heater that is low in thermal capacity. FIG. 11 shows an example of fixing apparatus that employs a heating belt. This fixing apparatus has a combination of a pair of halogen heaters 502 and 503 and a thin sleeve 202. The thin sleeve 202 is made up of a thin substrative sleeve formed of SUS, or the like, an elastic layer formed of rubber, or the like, and a release layer formed of PFA, or the like. The halogen heater 502, or the first heater, and the halogen heater 503, or the second heater, are different in heat generation range in terms of their lengthwise directions. The fixing apparatus is also provided with a sleeve supporting member 201, and a heating plate 504 (backup member), which are positioned in the hollow of the thin sleeve 202, along with the first and second heaters 502 and 503. Further, the fixing apparatus is provided with a pressure roller 210, which is kept pressed upon the outward surface of the thin sleeve 202, forming a compression nip N.

FIG. 12 shows an example of fixing apparatus that uses such a fixing method that fixes a toner image by pressing the toner image with a pressing belt while heating the toner image. The aforementioned first and second heaters 602 and 603, which are different in the lengthwise heat generation range, are in the hollow of the thin wall heat roller 604. That is, this fixing apparatus has a pressure unit that has a pressure application stay 607 and a pressure application pad 605 on the inward side of the pressure belt 606. It forms a compression nip N by pressing the pressure unit on the peripheral surface of the heat roller 604.

The fixing apparatuses shown in FIGS. 11 and 12 employ a pair of radiant heaters 502 and 503, and a pair of radiant heaters 602 and 603, respectively. The heaters are relatively small, however, in the overall thermal capacity. Therefore, as they temporarily fall in the amount of heat generation, their structural members fall in temperature, making it possible for a sheet P of recording paper to be insufficiently heated.

Therefore, the switching timing is determined (calculated) so that the drop in the amount of heat generation, which occurs as the heating unit is switched in the heat generation line with the use of a heater driving circuit and a control sequence, such as those in the first embodiment, during a printing job, does not coincide with the period in which an image bearing portion of a sheet P of recording paper is moving through the compression nip N. Then, the switching is made with this timing. Thus, the same effects as those obtained in the first embodiment can be obtained.

The technical concept of the present invention is applicable also to a fixing apparatus that employs a radiant heating means and is relatively small in thermal capacity, as described above.

Further, referring to FIG. 13, the technical concept of the present invention is applicable also to a fixing apparatus of the external heat application type, that is, a fixing apparatus structured so that heat is conducted to the peripheral surface of a fixation roller 800 from a heater 203 through a fixation nip N1 to thermally fix the toner image T on a sheet P of recording paper in a compression nip N2. Further, the technical concept of the present invention is also applicable to an unshown fixing apparatus that uses a heating method based on magnetic induction.

Usage of an image heating apparatus is not limited to the thermal fixation of an unfixed toner image T to a sheet of recording paper. It can also be effectively used as an image heating apparatus for temporarily fixing an unfixed image to a sheet of recording paper, an image heating apparatus for reheating a sheet of recording paper, on which an image is present, in order to improve the image in surface properties, or the like.

The application of the present invention is not limited to a fixing apparatus (image forming apparatus) of the so-called central conveyance. That is, the present invention is also applicable to a fixing apparatus (image forming apparatus) of the so-called offset conveyance type. Further, the application of the present invention is not limited to an image forming apparatus that employs an electrophotographic image forming portion (A2). That is, the present invention is also applicable to an image forming apparatus having an image forming portion that uses an electrostatic image recording method, a magnetic image recording method, or the like. Further, the application of the present invention is not limited to an image forming apparatus of the so-called transfer type. That is, the present invention is also applicable to an image forming apparatus structured so that an unfixed image is directly transferred onto a sheet of recording paper.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus for heating an image formed on a recording material, said apparatus comprising:

a nip forming unit providing a nip, and configured to nip and to feed the recording material;

a first heat generating element configured to heat said nip;

a second heat generating element configured to heat said nip;

a thyristor configured to control electrical power supplied to said first heat generating element and to said second heat generating element;

a relay configured to switch a supply destination of the electrical power supply between said first heat generating element and said second heat generating element; and a controller configured to control said thyristor and said relay, wherein, when said controller causes said relay to switch the supply destination from said first heat generating element to said second heat generating element during heating of images on continuously supplied recording materials, said controller switches said thyristor from an on-state to an off-state, and then actuates said relay to switch the supply destination from said first heat generating element to said second heat generating element, and, thereafter switches said thyristor from the off-state to the on-state, and wherein said controller sets a timing of switching of said thyristor from the on-state to the off-state to be in a period in which an image on a current recording material is nipped in said nip, and sets a timing of switching of said thyristor from the off-state to the on-state to be in a period in which the image on the current recording material and an image on a subsequent recording material is not nipped in said nip.

2. The apparatus according to claim 1, wherein said nip forming unit includes a cylindrical film, a roller contacting an outer surface of said film, and a back-up member provided in an inner space of said film and cooperating with said roller to form said nip through said film.

3. The apparatus according to claim 2, wherein said back-up member includes a heater having an elongated substrate, and wherein said first heat generating element and said second heat generating element are provided on said substrate.

4. The apparatus according to claim 2, wherein said first heat generating element and said second heat generating element are radiant heaters.

5. An image heating apparatus for heating an image formed on a recording material, said apparatus comprising:

a nip forming unit providing a nip configured to nip and to feed the recording material;

a first heat generating element configured to heat said nip;

a second heat generating element configured to heat said nip;

a thyristor configured to control electrical power supplied to said first heat generating element and to said second heat generating element;

a relay configured to switch a supply destination of the electrical power supply between said first heat generating element and said second heat generating element; and a controller configured to control said thyristor and said relay, wherein, when said controller causes said relay to switch the supply destination from said first heat generating element to said second heat generating element during heating of images on continuously supplied recording materials, said controller switches said thyristor from an on-state to an off-state, and then actuates said relay to switch the supply destination from said first heat generating element to said second heat generating element, and, thereafter, switches said thyristor from the off-state to the on-state, and wherein said controller sets a timing of switching said thyristor from the on-state to the off-state to be during an interval between adjacent recording materials passing through said nip, and wherein said controller sets the timing of switching of said thyristor from the on-state to the off-state to be in a period in which an image on a current recording material is nipped in said nip, and sets a timing of switching of said thyristor from the off-state to the on-state to be in a period in which the image on the current recording material and an image on a subsequent recording material is not nipped in said nip.

6. The apparatus according to claim 5, wherein said nip forming unit includes a cylindrical film, a roller contacting an outer surface of said film, and a back-up member provided in an inner space of said film and cooperating with said roller to form said nip through said film.

7. The apparatus according to claim 6, wherein said back-up member includes a heater having an elongated substrate, and wherein said first heat generating element and said second heat generating element are provided on said substrate.

8. The apparatus according to claim 6, wherein said first heat generating element and said second heat generating element are radiant heaters.

* * * * *